US010480304B2

(12) United States Patent
Mauldin et al.

(10) Patent No.: US 10,480,304 B2
(45) Date of Patent: Nov. 19, 2019

(54) ANALYSIS OF DRILLSTRING DYNAMICS USING AN ANGULAR RATE SENSOR

(71) Applicant: Precision Energy Services, Inc., Fort Worth, TX (US)

(72) Inventors: Charles Lee Mauldin, Spring, TX (US); Roger P. Bartel, Spring, TX (US); Richard Berns, Conroe, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 1356 days.

(21) Appl. No.: 13/651,138

(22) Filed: Oct. 12, 2012

(65) Prior Publication Data

US 2013/0092439 A1 Apr. 18, 2013

Related U.S. Application Data

(60) Provisional application No. 61/547,604, filed on Oct. 14, 2011.

(51) Int. Cl.
*E21B 44/00* (2006.01)

(52) U.S. Cl.
CPC ..... *E21B 44/00* (2013.01)

(58) Field of Classification Search
CPC ..... E21B 47/00; E21B 47/01; E21B 47/12; E21B 47/022; E21B 47/024; E21B 44/00
See application file for complete search history.

(56) References Cited

U.S. PATENT DOCUMENTS 3,713,500 A 1/1973 Russell
3,841,420 A 10/1974 Russell
4,542,647 A * 9/1985 Molnar ..... 73/152.54
4,674,331 A 6/1987 Watson
5,432,699 A * 7/1995 Hache ..... E21B 47/022 702/9
5,592,381 A * 1/1997 Henneuse ..... E21B 44/005 340/853.2
5,738,178 A 4/1998 Williams et al.
5,864,058 A 1/1999 Chen
(Continued)

FOREIGN PATENT DOCUMENTS

EP 0 443 689 A2 2/1991
WO 0235048 A1 5/2002
(Continued)

OTHER PUBLICATIONS

Khulief et al, Vibration analysis of drillstrings with self-excited stick-slip oscillations, Journal of Sound an Vibration 299 (2007) 540-558).*
(Continued)

*Primary Examiner* — William D Hutton, Jr.
*Assistant Examiner* — Steven A MacDonald
(74) *Attorney, Agent, or Firm* — Blank Rome, LLP

(57) ABSTRACT

Downhole drilling vibration analysis uses an angular rate sensor on a drilling assembly. During drilling operations, the sensor measures the angular rate of the drilling assembly. Processing circuitry is operatively coupled to the angular rate sensor and is configured to determine whether torsional type vibrations are occurring during drilling based on the angular rate data. Drilling operations can then be modified to overcome or mitigate the torsional type vibrations.

49 Claims, 13 Drawing Sheets

(56) References Cited

U.S. PATENT DOCUMENTS

| | | | | |
|---|---|---|---|---|
| 6,166,654 | A | 12/2000 | Van Den Steen | |
| 6,205,851 | B1 | 3/2001 | Jogi | |
| 6,518,756 | B1 * | 2/2003 | Morys | E21B 47/00 324/300 |
| 6,571,870 | B2 | 6/2003 | Zheng et al. | |
| 6,585,061 | B2 | 7/2003 | Radzinski et al. | |
| 6,714,870 | B1 * | 3/2004 | Weston et al. | 702/9 |
| 7,058,512 | B2 | 6/2006 | Downtown | |
| 7,313,480 | B2 | 12/2007 | Chen et al. | |
| 2003/0010534 | A1 * | 1/2003 | Chen | E21B 7/067 175/61 |
| 2004/0245017 | A1 | 12/2004 | Chen et al. | |
| 2005/0193811 | A1 * | 9/2005 | Bilby | E21B 47/09 73/152.43 |
| 2005/0224257 | A1 * | 10/2005 | Ekseth et al. | 175/45 |
| 2006/0271299 | A1 | 11/2006 | Ward et al. | |
| 2008/0294344 | A1 | 11/2008 | Sugiura | |
| 2009/0138242 | A1 | 5/2009 | Pabon | |
| 2009/0194332 | A1 | 8/2009 | Pastusek et al. | |
| 2010/0082256 | A1 | 4/2010 | Mauldin et al. | |
| 2011/0077924 | A1 | 3/2011 | Ertas et al. | |
| 2011/0108327 | A1 | 5/2011 | Farley et al. | |
| 2011/0147083 | A1 | 6/2011 | Mauldin et al. | |
| 2011/0214878 | A1 * | 9/2011 | Bailey et al. | 166/369 |
| 2012/0123757 | A1 * | 5/2012 | Ertas | E21B 45/00 703/2 |
| 2012/0130693 | A1 * | 5/2012 | Ertas | E21B 44/00 703/2 |
| 2012/0228028 | A1 * | 9/2012 | Turner | E21B 17/07 175/56 |
| 2013/0211723 | A1 * | 8/2013 | Weston et al. | 702/6 |
| 2013/0277110 | A1 * | 10/2013 | Doris | E21B 44/00 175/24 |
| 2014/0102795 | A1 * | 4/2014 | VanSteenwyk | 175/45 |
| 2014/0318865 | A1 * | 10/2014 | Doris | E21B 44/00 175/40 |

FOREIGN PATENT DOCUMENTS

| | | | |
|---|---|---|---|
| WO | 2004/065749 | A2 | 8/2004 |
| WO | 2006089258 | | 8/2006 |

OTHER PUBLICATIONS

Kreuzer et al, Analysis of long torsional strings by proper orthogonal decomposition , Archive of Applied Mechanics 67 (1996) 68-80.*

Richard, Self-excited stick-slip oscillations of drill bits, C. R. Mecanique 332 (2004) 619-626.*

Richard, A simplified model to explore the root cause of stick-slip vibrations in drilling systems with drag bits, Journal of Sound and Vibration 305 (2007) 432-456.*

Silveira, Low dimensional models for stick-slip vibration of drill-strings 2009 J. Phys.: Conf. Ser. 181 012056.*

Greenberg, J., "Weatherford Sensors Track Vibration to Increase ROP, Temperature CHnage for Early Kick Detection," Mar./Apr. 2008. 2 pgs.

Weatherford International Ltd., "HEL™ MWD System-Environmental Severity Measurement (ESM™) Sensor," © 2006, obtained from www.weatherford.com, 3 pgs.

Drilling Contractor, "Innovating While Drilling," Mar./Apr. 2008, 2 pgs.

Abdulgalil, F., et al, "Nonlinear Friction Compensation Design for Suppressing Stick Clip Oscillations in Oilwell Drillstrings," © 2004 IFAC, 5 pgs.

Sugiura, et al, "Detect Near-Bit Vibration in Real Time," Jul. 2008 E&P, obtained from www.EPmag.com, 5 pgs.

Navarro-Lopez, E.M., et al., "Modelling & Ananlysis of Stick-Slip Behaviour in a Drillstring under Dry Friction," Congreso Anual de la Amca 2004, 6 pgs.

Navarro-Lopez, E.M., et al., "Practical Approach to Modelling & Controlling Stick-Slip Oscillations in Oilwell Drillstrings," Proceedings of 2004 IEEE International Conference on Control Applications, Taipei, Taiwan, Sep. 2-4, 2004, 7 pgs.

Baker Hughes, "Advancing Reservoir Performance: Overview-Vibration/Stick-Slip Monitoring (VSS®)," © 2009, obtained from www.bakerhughesdirect.com.

Silveria, M., et al, "Low dimensional models for stick-slip vibration of drill-strings," Journal of Physics: Conference Series 181 (2009) 012056 © 2009 IOP Publishing, 8 pgs.

Leine, R.I., et al., "Stick-Slip Whirl Interaction in Drillstring Dynamics," Journal of Vibrations and Acoustics © 2002 by ASME Apr. 2002, vol. 124, 12 pgs.

Leine, R.I., et al., "Stick-Slip Whirl Interaction in Drillstring Dynamics," Eidenhoven University of Technology, undated, 10 pgs.

Khulief, Y.A., et al., "Vibration analysis of drillstrings with self-excited stick-slip oscillations," Journal of Sound and Vibration 299 (2007) 540-558, obtained from www.elsevier.com/locate/jsvi, 19 pgs.

Sugiura, M., et al., "Automated Drilling and Real-Time Drilling Process Monitoring Optimize RSS Underreamer Technology," obtained from www.drillingcontractor.org, generated on Oct. 21, 2009, 3 pgs.

Richard, T., et al.,"A simplified model to explore the root cause of stick-slip vibrations in drilling systems with drag bits," Journal of Sound and Vibration 305 (2007) 432-456, obtained from www.elsevier.com/locate/jsvi, 25pgs.

Schlumberger, "Shock and vibration mitigation," Jul. 2007, 1 pg.

Richard, T., et al. "Self-Excited Stick-Slip Oscillations of Drag Bits," XXI ICTAM, Aug. 15-21, 2004, Warsaw, Poland, 2 pgs.

Sugiura, J., " The Use of the Near-bit Vibration Sensor While Drilling Leads to Optimized Rotary-Steerable Drilling in Push-and Point-the-Bit Configurations," © 2008, Society of Petroleum Engineers, SPE 115572, 10 pgs.

Warren, T.M., et al. "Torsional Resonance of Drill Collars with PDC Bits in Hard Rock," © 1998, Society of Petroleum Engineers, SPE 49204, 13 pgs.

Khulief, Y.A., et al., "Finite element dynamic analysis of drillstrings," Finite Elements in Analysis and Design 41 (2005) 1270-1288, obtained from www.elsevier.com/locate/finel, 19 pgs.

Green, J. et al., "New iMEMS(R) Angular-Rate-Sensing Gyroscope," Analog Dialogue, dated 2003.

MacPherson, John, "The Science of Stick-Slip," IADC Stick-Slip Mitigation Workshop, Jul. 15, 2010.

International Search Report and Written Opinion received in corresponding PCT Patent Application No. PCT/US2012/060098, dated Jan. 23, 2013.

MacPherson, John, "The Science of Stick-Slip," IADC Stick-Slip Mitigation Workshop, Jul. 15, 2010. (Previously cited on Oct. 15, 2012.).

First Office Action in counterpart Canadian Appl. 2,849,768, dated May 27, 2015.

Third Office Action in counterpart Canadian Appl. 2,849,768, dated May 10, 2017, 4-pgs.

Notice of Allowance in counterpart Canadian Appl. 2,849,768, dated Feb. 21, 2018, 1-pg.

Examination Report in counterpart EP Appl. 12840203.9, dated Nov. 6, 2017, 5-pgs.

* cited by examiner

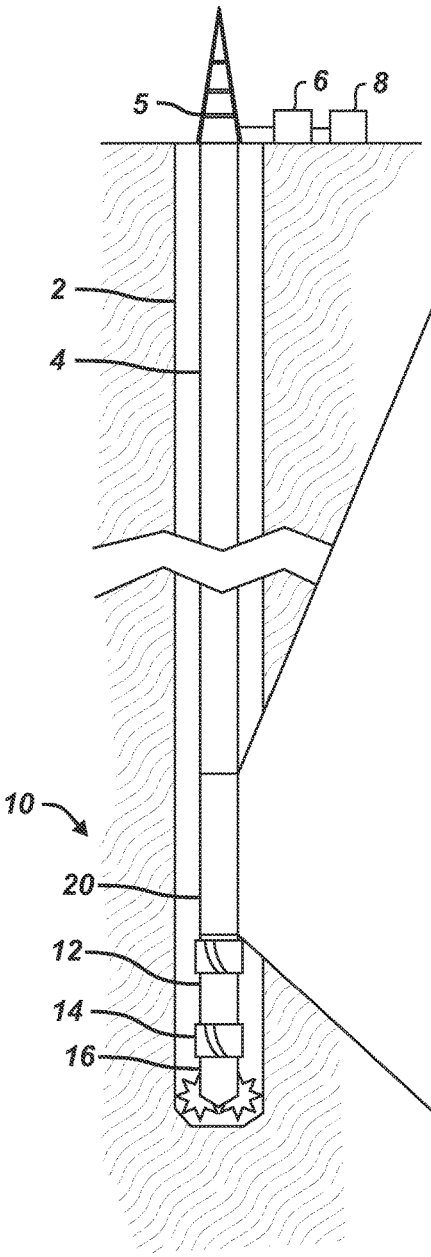
FIG. 1
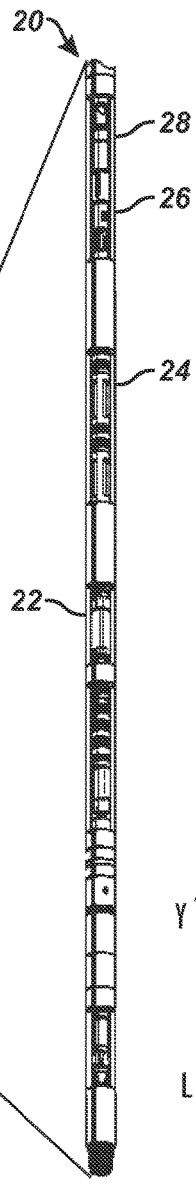
FIG. 2A
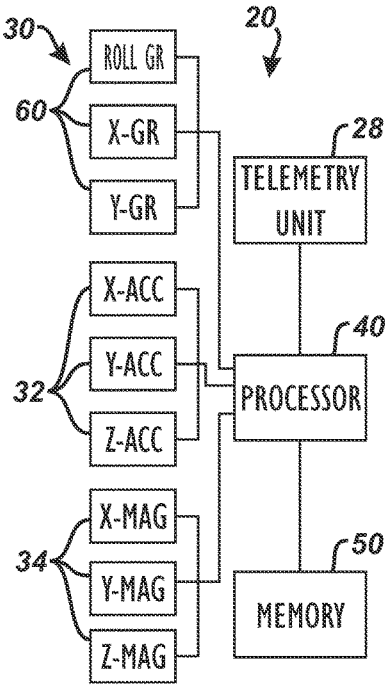
FIG. 2B
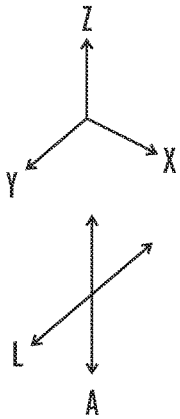

(Stick-Slip)

(Whirl)

ANALYSIS OF DRILLSTRING DYNAMICS USING AN ANGULAR RATE SENSOR

CROSS-REFERENCE TO RELATED APPLICATIONS

This application claims the benefit of U.S. Provisional Appl. No. 61/547,604, filed 14 Oct. 2011, which is incorporated herein by reference and to which priority is claimed.

BACKGROUND

To explore for oil and gas, operator drill a well by rotating a drillstring having a drill bit and drill collars to bore through a formation. In a common form of drilling called rotary drilling, a rotary table or a top drive rotates a drillstring, which has a bottom hole assembly (BHA) with increased weight to provide necessary weight on the assembly's bit. During the drilling operation, vibrations occurring in the drillstring can reduce the assembly's rate of penetration (ROP). Therefore, it is useful to monitor vibration of the drillstring, bit, and BHA and to monitor the drilling assembly's rate of rotation to determine what is occurring downhole during drilling. Based on the monitored information, a driller can then change operating parameters, such as weight on the bit (WOB), drilling collar RPM, and the like, to increase drilling efficiency.

Because the drillstring can be of considerable length, it can undergo elastic deformations, such as twisting, that can lead to rotational vibrations and considerable variations in the drill bit's speed. For example, stick-slip is a severe torsional vibration in which the drillstring sticks for a phase of time as the bit stops and then slips for a subsequent phase of time as the drillstring rotates rapidly. When it occurs, stick-slip can excite severe torsional and axial vibrations in the drillstring that can cause damage. In fact, stick-slip can be the most detrimental type of torsional vibration that can affect a drillstring.

For example, the drillstring is torsionally flexible so friction on the drill bit and drilling assembly as the drillstring rotates can generate stick-slip vibrations. In a cyclic fashion, the bit's rotational speed decreases to zero. Torque of the drillstring increases due to the continuous rotation applied by the rotary table, and the torque accumulates as elastic energy in the drillstring. Eventually, the drillstring releases this energy and rotates at speeds significantly higher than the speed applied by the rotary table.

The speed variations can damage the BHA, the bit, and the like and can reduce the drilling efficiency. To suppress stick-slip and improve efficiency, prior art systems, such as disclosed in EP 0 443 689, have attempted to control the speed imparted at the rig to dampen any rotational speed variations experienced at the drill bit.

In whirl vibrations (also called bit whirl), the bit, BHA, or the drillstring rotates about a moving axis (precessional movement) with a different rotational velocity with respect to the borehole wall than what the bit would rotate about if the axis were stationary. Such precessional movement is called forward whirl when faster compared to rotation expected if the bit axis were stationary, and the precessional movement is called backward whirl when slower. Thus, in backward whirl, for example, friction causes the bit and BHA to precess around the borehole wall in a direction opposite to the drillstring's actual rotation. For this reason, backwards whirl can be particularly damaging to drill bits. Whirl is self-perpetuating once started because centrifugal forces create more friction. Once whirl starts, it can continue as long as bit rotation continues or until some hard contact interrupts it.

As noted above, stick-slip and bit whirl during drilling operations causes inefficiencies and can lead to failure of components downhole. An additional detrimental phenomenon is torsional vibration and torsional resonance of a drillstring or BHA. For example, effects of torsional resonance on drill collars having PDC bits in hard rock are discussed in SPE 49204, by T. M. Warren, et al. and entitled "Torsional Resonance of Drill Collars with PDC Bits in Hard Rock."

When detrimental vibrations occur downhole during drilling, operators want to change aspects of the drilling parameters to reduce or eliminate the vibrations. If left unaddressed, the vibrations will prematurely wear out the bit, damage the BHA, or produce other detrimental effects. Typically, operators change the weight on bit, the rotary speed (RPM) applied to the drilling string, or some other drilling parameter to deal with vibration issues. Thus, the instantaneous diagnosis of detrimental vibrations can enable drilling operations to take timely corrective action to mitigate or stop the vibrations.

Unfortunately, existing data collection may not give a complete understanding of what is occurring to the drilling assembly downhole. Attempts to detect vibrations during drilling have historically used accelerometers in a downhole sensor sub to measure accelerations during drilling and to analyze the frequency and magnitude of peak frequencies detected. As will be appreciated, the accelerometers in the downhole sensor sub are susceptible to spurious vibrations and can produce a great deal of noise. In addition, some of the mathematical models for processing accelerometer data can involve several parameters and can be cumbersome to calculate in real-time when a drilling operator needs the information the most. Lastly, the processing capabilities of hardware used downhole can be somewhat limited, and telemetry of data uphole to the surface may have low available bandwidth.

The subject matter of the present disclosure is directed to overcoming, or at least reducing the effects of, one or more of the problems set forth above.

SUMMARY

The teachings of the present disclosure detect and measure detrimental vibrations from rotary stick-slip, whirl, and torsional vibration. Torsional vibration refers to the angular vibration that occurs along the rotational axis in a shaft or the like as it experiences changes in torque. In drilling assemblies, torsional vibration can occur in any of the rotating longitudinal bodies used downhole, such as drillstring, tubular, drill collars, etc. Torsional vibration can create torsional resonance when the vibration reaches a natural frequency of the drillstring or the like. In some instances, the amplitude at which the angular rate changes may indicate that torsional resonance is occurring. In any event, torsional vibration (and especially torsional resonance) that occurs during drilling operations can damage the drillstring and other components by creating fatigue and rapid failure of downhole components.

To detect and measure torsional vibration, a drilling assembly obtains instantaneous downhole angular velocity measurements of the assembly using one or more angular rate sensors, and more particularly an angular rate gyroscope, such as an Angular Rate-Sensing (ARS) Gyro responsive to Coriolis acceleration. Existing sensors and techniques (acquisition and processing) are inferior in determining instantaneous changes in angular velocity and direction. The angular rate sensor, however, is able to make the instantaneous angular velocity measurements at the drilling assembly, which offers several advantages. The drilling assembly can make these downhole measurements and can send real-time transmission of the drillstring's angular velocity to processing equipment for vibrational analysis. The drilling assembly can also make downhole measurements and real-time transmission of the drillstring's stick-slip and whirl conditions, which operators can use in controlling drilling operations.

Finally, the drilling assembly can automatically actuate downhole mechanisms to disrupt the detrimental vibration without operator intervention. For example, a downhole controller can use measurements by the angular rate gyroscope sensor and can provide feedback to actuate a torque clutch or other mechanism automatically. When actuated, the mechanism can interrupt the drilling for a period of time before re-engaging o detrimental vibration can be disrupted and the conditions causing it can be stopped or mitigated.

Having a drilling system able to measure and transmit this vibration information enables operators to mitigate detrimental effects on the drillstring. To do this, the drilling system directly measures data indicative of torsional vibration, stick-slip, whirl, and reverse rotation of the drillstring with the angular rate sensor. Once measured, this information is at least partially processed and transmitted to the surface and notifies operators of the conditions downhole. In turn, indications of detrimental vibrations allow operations to take corrective actions and to avoid the damaging effects of torsional vibration, stick-slip, whirl, and reverse rotation of the drillstring.

Being a gyroscope responsive to Coriolis acceleration, the angular rate sensor is immune to lateral acceleration, vibration, etc. when measuring angular rate so the sensor is well suited to detect torsional vibration in a drilling environment. This makes the sensor and disclosed techniques suitable for use with a variety of rotary drilling assemblies, including conventional drilling tools and rotary steerable tools. In practice, a complete instantaneous diagnosis of downhole torsional vibration, stick-slip, whirl, and other phenomena may be achieved by analyzing data from a combination of angular rate sensors, accelerometers, magnetometers, and other types of sensors.

The foregoing summary is not intended to summarize each potential embodiment or every aspect of the present disclosure.

BRIEF DESCRIPTION OF THE DRAWINGS

FIG. 1 illustrates a drilling system according to the present disclosure.

FIGS. 2A-2B illustrate a monitoring tool of the drilling system in more detail.

DETAILED DESCRIPTION

A. Drilling Assembly

Figure 3:
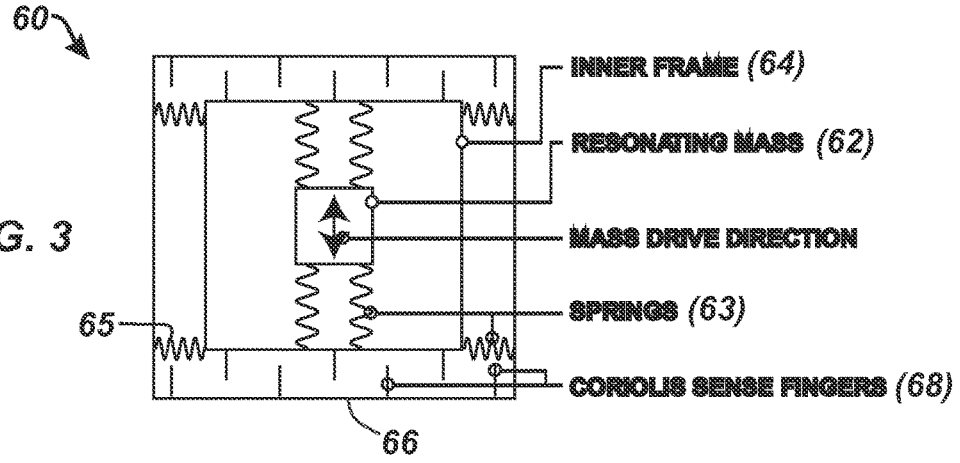
FIG. 3 schematically illustrates an angular rate sensor for the disclosed monitoring tool.

FIG. 1 shows a bottomhole assembly (BHA) or drilling assembly 10 suspended in a borehole 2 penetrating an earth formation. The drilling assembly 10 connects to a drillstring 4, which in turn connects to a rotary drilling rig uphole (represented conceptually at 5). The drilling assembly 10 includes a drill bit 16, which may be a polycrystalline diamond compact (PDC) bit, a rotary drilling bit rotated by a motor and shaft, or any other suitable type of drill bit. In addition to the drill bit 16, the BHA 10 can have a drill collar 12, one or more stabilizers 14, and other conventional components (i.e., motor, rotary steerable system, etc.).

During drilling operations, the rotary rig 5 imparts rotation to the drill bit 16 by rotating the drillstring 4 and drilling assembly 10. Surface equipment 6 typically controls the drillstring's rotational speed. In addition, a drilling fluid system 8 circulates drilling fluid or "mud" from the surface downward through the drillstring 4. The mud exits through the drill bit 16 and then returns cuttings to the surface via the annulus. If the drilling assembly 10 has a motor (not shown), such as a "mud" motor, then motor rotation imparts rotation to the drill bit 16 through a shaft. The motor may have a bent sub, which can be used to direct the trajectory of the advancing borehole 2.

FIG. 2A shows portion of the drilling assembly 10 in more detail. As shown, the drilling assembly 10 has a monitoring tool 20, components of which are diagrammatically shown in FIG. 2B. Briefly, the tool 20 has a sensor section 22, a power section 24, an electronics section 26, and a telemetry section 28. The sensor section 22 has a sensor element 30, which includes one or more angular rate sensors 60 as disclosed herein. The sensor element 30 can also include accelerometers 32 and magnetometers 34 to indicate the orientation (azimuth, inclination, and toolface) of the drilling assembly 10 within the borehole 2. The sensor section 22 can also have other sensors used in Measurement-While-Drilling (MWD) and Logging-While-Drilling (LWD) operations including, but not limited to, sensors responsive to gamma radiation, neutron radiation, and electromagnetic fields.

The electronics section 26 houses electronic circuitry to operate and control other elements within the drilling assembly 10 and includes memory 50 for storing measurements made by the sensor section 22 and a processor(s) 40 to process various measurement and telemetry data.

The telemetry section 28 communicates data with the surface by receiving and transmitting data to an uphole telemetry section (not shown) in surface equipment 6. Various types of borehole telemetry systems are applicable, including mud pulse systems, mud siren systems, electromagnetic systems and acoustic systems. The power section 24 supplies electrical power needed to operate the other elements within the drilling assembly 10.

During drilling, the monitoring tool 20 monitors the motion and revolutions-per-minute (RPM) of the drilling assembly 10 (collar 12, stabilizer 14, drill bit 16, etc.) on the drillstring 4. To monitor the drilling assembly's motion, the tool 20 has the sensor element 30 (which as noted above includes the angular rate sensors 60 and may include accelerometers 32, and magnetometers 34) so the sensor element 30 can provide information about torsional variations, stick-slip, whirl, and other vibrations occurring during drilling.

As is known, the magnetometer 34 can be a fluxgate device whose output indicates its orientation with respect to the earth's magnetic field. Accordingly, the magnetometers 34 can be used to calculate the azimuth and magnetic toolface of the tool 20. "Azimuth" refers to an angle in a horizontal plane measured relative to magnetic north. Magnetic toolface is typically measured clockwise from the reference magnetic north bearing, beginning at 0° and continuing through 360°.

The tool 20 can also have the accelerometers 32 arranged orthogonally to one another and directly coupled to the insert in the tool 20. The accelerometers 32 are intended to measure acceleration forces acting on the tool 20. The accelerometers 32 can measure inclination and toolface with respect to gravity of the tool 20, and they can also detect vibration and shock experienced by the drillstring 4 downhole. The downhole RPM obtained by the tool 20 combined with the accelerometer and magnetometer data helps identify the dynamics downhole. Knowing the type(s) of vibration allows operators to determine what parameters to change to alleviate the experienced vibration.

Finally, the tool 20 has at least one angular rate sensor 60 disposed on the tool's roll axis (i.e., a "roll gyroscope" is set to sense rotation of the drilling assembly around the assembly's longitudinal or Z-axis). The angular rate sensor 60 measures the angular rate or velocity of the tool 20 as it rotates downhole during drilling. Further details of the preferred angular rate sensor 60 are discussed below with reference to FIGS. 3 and 4A-4B.

If desirable, the tool 20 can have one or more other angular rate sensors 60 arranged on other axes of the tool 20. These other sensors 60 can be mounted perpendicular to one another and can measure pitch and yaw of the tool 20 during drilling by measuring the angular rate or velocity in the X and Y-axes.

In general, the tool 20 does not need to determine a geometric reference of the borehole (e.g., magnetic north or a highside of a horizontal borehole) during drilling in some implementations. Yet, a geometric reference, such as magnetic north, highside of a horizontal borehole, and the like, can be determined by the processor 40 using the accelerometers 32, the magnetometers 34, or other sensors based on techniques known in the art. The determined geometric reference can then be applied periodically to the measurements of the angular rate sensors 60 so the measurements are synced to the geometric reference, which can be beneficial in some implementations.

Along the same lines as synchronizing the measurements of the angular rate sensors 60 to a geometric reference, it may be desirable to re-bias the angular rate sensors 60 periodically during operation. Being electronic devices outputting voltage, the angular rate sensors 60 have a bias due to inherent factors, temperature, and the like. The processor 40 accounts for this bias when processing the measurements obtained by the sensors 60. Periodically, when rotation of the tool 20 is stopped, the processor 40 can determine the bias of the sensors 60 so a corrected bias can be taken out of the subsequent measurements of the sensors 60. These procedures can prevent a "walk" of the measurements as the sensors 60 function overtime.

The tool 20 is programmable at the well site so that it can be set with real-time triggers that indicate when the tool 20 is to transmit vibration data to the surface. As noted previously, the tool's processor 40 processes raw data downhole and transmits processed data to the surface using the telemetry system 28. Alternatively, the tool 20 can transmit raw data to the surface where processing can be accomplished using surface processing equipment 6 (FIG. 1). The tool 20 can also record data in memory 50 for later analysis. Finally, the processor 40, angular rate sensors 60, accelerometers 32, magnetometers 34, memory 50, and telemetry unit 28 can be those suitable for a downhole tool, such as used in Weatherford's HEL system.

During drilling, various forms of vibration may occur to the drillstring 4 and the drilling assembly 10 (i.e., drill collar 12, stabilizers 14, and drill bit 16 as well as bent sub, motor, rotary steerable system (not shown), etc.). In general, the vibration may be caused by properties of the formation being drilled, by the drilling parameters being applied to the drillstring 4, the characteristics of the drilling components, and other variables. Regardless of the cause, the vibration can damage the drilling assembly 10, reducing its effectiveness and requiring one or more of its components to be eventually replaced or repaired.

Several real-time data items and calculations can be used for analyzing the vibration experienced by the drillstring 4 during drilling, and the real-time data items and calculations can be provided by the monitoring tool 20 of FIGS. 1 and 2A-2B. In one implementation, real-time data items can cover acceleration, RPM, peak values, averages, angular velocity, etc. As detailed herein, tracking these real-time data items along with vibration calculations helps operators to monitor drilling efficiency and determine when the drilling parameters need to be changed. To deal with damage and wear on the drilling assembly 10, the techniques of the present disclosure identify and quantify levels of torsional, stick-slip, and whirl vibrations, which in turn can indicate wear or damage to the assembly 10.

To identify and quantify levels of stick-slip and whirl vibrations, the tool 20 uses its x and y-axis magnetometers 34 to measure the radial velocity the drillstring 4 at particular toolfaces or radial orientations of the drillstring 4. (In general, the magnetometers 34 can at least be used in a vertical well to determine magnetic north toolface.) The radial velocity can be measured in terms of revolutions per minute (RPM) or other units of measure.

The processor 40 then records the radial velocity (RPM) data in memory 50 at particular toolfaces and processes the toolface RPM data using calculations as detailed below to determine the type and extent of vibration. In turn, the processor 40 can transmit the data itself, some subset of data, or any generated alarm to the surface. In addition to or in an alternative to processing at the tool 20, the raw data from the magnetometers 34 and other sensors 30 can be transmitted to the surface where the calculations can be performed by the surface processing equipment 6 for analysis.

The tool 20 can store the variation in rotational speed within downhole memory 50. Also, some or all of the information, depending on the available bandwidth and the type of telemetry, can be telemetered to the surface for additional processing. In any event, the processor 40 at the tool 20 can monitor the data to detect detrimental vibrations caused by slip/stick and/or whirl. This can trigger an alarm condition, which is telemetered uphole instead of the data itself. Based on the alarm condition, operators can adjust appropriate drilling parameters to remove the detrimental vibration.

If stick-slip is detected, for example, drilling operators may be able to reduce or eliminate stick-slip vibrations by adjusting rotary speed and/or weight on bit (WOB). Alternatively, the drilling operators can use a controller on the rotary drive that varies the energy provided by the rotary drive and interrupts the oscillations that develop. Whirl, however, may be self-perpetuating. Therefore, in some instances, drilling operators may only be able to eliminate whirl vibration by stopping rotation altogether (i.e., reducing the rotary speed to zero) as opposed to simply adjusting the rotary speed and/or weight on bit. Of course, drilling operators can apply these and other techniques to manage the drilling operation and reduce or eliminate detrimental vibrations.

Further details of this process of identifying and quantifying levels of stick-slip and/or whirl vibrations are provided in co-pending U.S. application Ser. No. 12/971,202, filed 17 Dec. 2010, which is incorporated herein by reference in its entirety.

B. Details of Angular Rate Sensor

To identify and quantify levels of torsional vibrations, the tool 20 uses the angular rate sensor 60 as noted herein. Turning now to FIG. 3, an angular rate sensor 60 for the present disclosure is schematically illustrated. A suitable form of angular rate sensor for use with the disclosed techniques includes an angular rate gyroscope responsive to Coriolis acceleration, and a suitable example is the iMEMS® Angular-Rate-Sensing Gyroscopes available from Analog Devices.

Preferably, the angular rate sensor 60 is configured for the downhole environment and conditions of interest. In particular, commonly available angular rate sensors can only measure up to about 50 RPM. Higher RPMs are needed for the downhole environment, and the disclosed angular rate sensor 60 for the present disclosure is preferably accurate to +/−400 RPM.

In any event, the angular rate sensor 60 for the present disclosure is immune to magnetic fields, centrifugal force, and linear acceleration and can be sufficiently accurate to low angular rates, even less than 1 RPM. Thus, the angular rate sensor 60 is not susceptible to changes in inclination or magnetic fields. In the end, the sensor 60 is capable of accurately measuring variations in rotational speed while in the presence of vibrational shocks, magnetic fields and high temperatures, etc., and may be capable of other functions suitable for downhole use to detect torsional vibrations.

The angular rate sensor 60 measures the angular rate of an object on which the sensor 60 is mounted (i.e., the sensor 60 measures how quickly the drilling assembly 10 turns while drilling). As the sensor 60 turns, it outputs a voltage proportional to the angular rate (e.g., mV/degree/second). To measure the angular rate, the sensor 60 uses Coriolis acceleration, which is the rate of increase of a mass' tangential speed caused by the mass' radial velocity.

As an angular rate gyroscope, the sensor 60 has a mass 62 that takes advantage of the Coriolis Effect. The mass 62 can be micro-machined polysilicon tethered to a polysilicon frame 64 by springs 63 so that the mass 62 resonates in only one direction. The frame 64 containing the mass 62 is tethered to a substrate 66 by springs 65 perpendicular to the resonating motion of the mass 62.

Figure 4A:
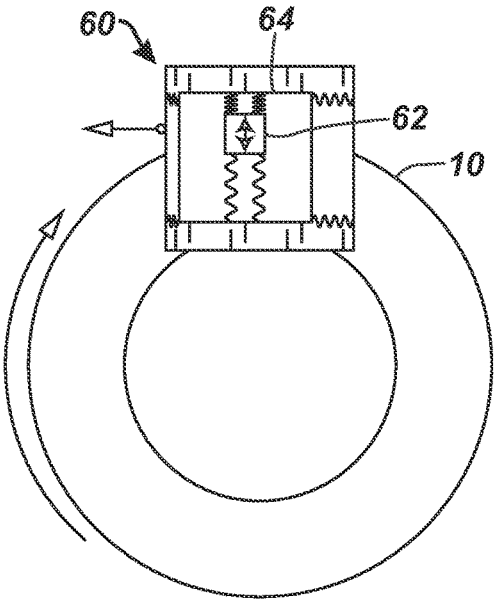
FIGS. 4A-4B shows how the angular rate sensor is responsive to Coriolis acceleration relative to a drilling assembly.
Figure 4B:
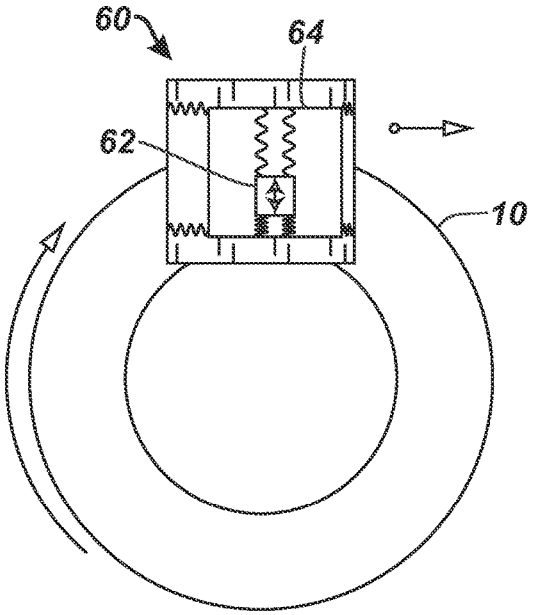

As shown in an exaggerated view in FIG. 4A, the sensor 60 with the mass 62 and frame 64 mounts on the drilling assembly 10. When the mass 62 moves towards the outer edge of the drillstring's drilling assembly 10 as it rotates, the mass 62 is accelerated to the right and exerts a reaction force on the frame 64 in the opposite (i.e., left) direction as indicated by the arrow. In contrast, when the mass 62 moves inward from the outer edge as it rotates, the reaction force is exerted on the frame 64 to the right as indicated by the arrow in FIG. 4B. On the sensor 60 as shown in FIG. 3, Coriolis sense fingers 68 capacitively sense displacement of the frame 64 in response to the forces exerted by the mass 62 during the movement from the reaction force.

Advantageously, the angular rate sensor 60 is immune to shock and vibration, and experimentation has verified this when disposed on a drill collar and rotated at higher RPMs. As is known, the drilling environment creates a great deal of shock and vibration that can make measurements replete with noise and sometime useless. This angular rate sensor 60, however, does not sense changes due to centrifugal force so it only measures angular rate. This is an advantage over typical accelerometers, which are very susceptible to vibration. In the end, being able to measure angular rate of the drilling assembly (10) with the disclosed sensor 60 without interference from shock and vibration is, therefore, particularly useful in determining torsional vibration in the drillstring.

C. Vibration Analysis Technique

Figure 5:
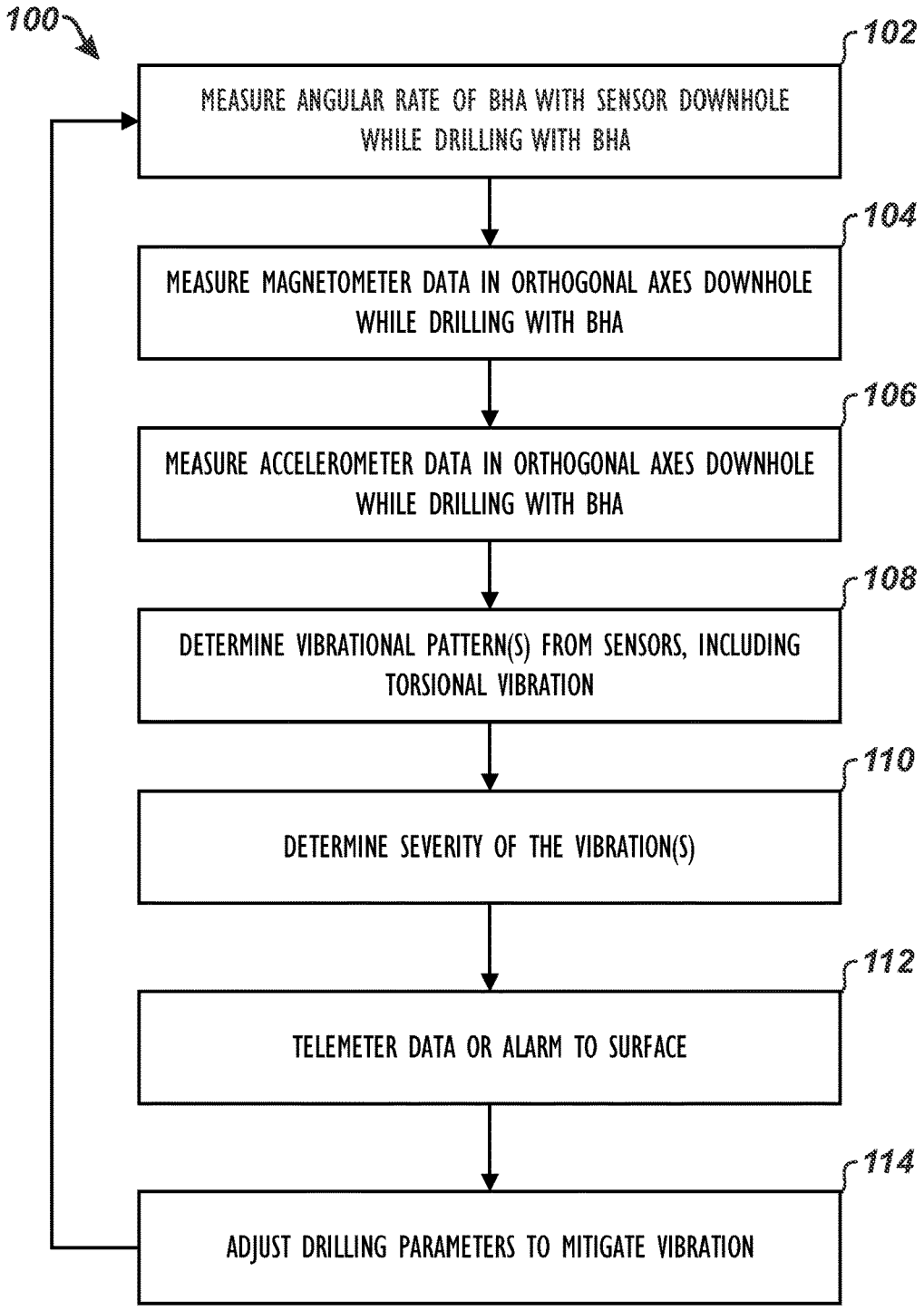
FIG. 5 is a flowchart showing a technique for determining whether detrimental vibrations are occurring downhole.

With an understanding of the monitoring tool 20 and sensors, such as the angular rate sensor 60, discussion now turns to FIG. 5, showing an analysis technique 100 according to the present disclosure in which detrimental vibration of the drillstring 4 is determined. The technique 100 uses the tool 20 of FIGS. 2A-2B having the sensor element 30, processor 40, memory 50, and telemetry unit 28.

Initially, the tool 20 measures angular rate of the drilling assembly with the angular rate sensor 60 as noted herein (Block 102). Additionally, the tool 20 can measure magnetometer data with the magnetometers 34 (Block 104) and can measure accelerometer data with the accelerometers 32 (Block 106) in orthogonal axes downhole while drilling. For example, the 360-degree rotational cycle of the drilling assembly 10 is configured into bins or segments to facilitate the data acquisition. During drilling, the tool 20 measures data from the x and y-axis magnetometers 34, and the processor 40 applies the geometric reference angle to the sensor element 30 and derives a toolface velocity (RPM) of the drilling assembly 10.

As the tool 20 rotates on the drilling assembly 10, data for a streaming toolface can come from any of a number of sources downhole. Preferably, the orthogonal magnetometers 34 are used because of their immunity to noise caused by vibration. However, other sensors could be used, including the angular rate sensors 60 and accelerometers 32.

The processor 40 can use the toolface binning to derive the toolface velocity (RPM) during drilling, which produces a less complicated and cumbersome model. From the resulting toolface velocity (RPM) data, the processor 40 recognizes whether detrimental vibrations are occurring (Block 108).

In particular, the processor 40 can determine if detrimental vibrations are occurring from stick-slip and/or whirl (Block 108). Still further in Block 108, the processor 40 can determine whether torsional vibration is occurring. As discussed herein, this determination can distinctly use the angular rate sensor 60, which measures the angular rate of the drilling assembly 10.

In measuring the angular rate, the disclosed techniques are not particularly interested in the actual highside or magnetic toolface (geometric reference), although such a geometric reference can be helpful. In other words, binning the RPM of the tool 20 may not be of interest, although it may be useful for determining stick-slip or bit-whirl as noted herein. In any event, the angular rate data can be combined with geometric reference, accelerometer, and magnetometer data to provide more details about the downhole vibrations.

Once detrimental vibration is encountered, the processor 40 proceeds to determine the severity of the vibrations (Block 110). The level of severity can depend on the type of vibration, the level of the vibration, the time span in which the vibration occurs, or a combination of these considerations as well as others, such as any cumulative effect or extent of the drilled borehole in which the vibration occurs. Accordingly, the details of the detrimental vibrations are compared to one or more appropriate thresholds.

If the vibrations are sufficiently severe, then the processor 40 uses the telemetry unit 28 to telemeter raw data, processed data, alarm conditions, or each of these uphole to the surface equipment 6 (Block 112). For example, telemetry of an alarm or warning can be done when severe variations in RPM are occurring, which could indicate stick-slip, whirl, or torsional vibration. The tool 20 can pulse up details of the detrimental vibration, such as a severity measure or various levels of torsional vibration including low, moderate, and high.

Drilling operators receive the data, and the surface equipment 6 displays the information and can further process the information. Once the detrimental vibrations are known, corrective action can be taken. For example, drilling operators can manually adjust drilling parameters to counteract the vibration, or the surface equipment 6 can automatically adjust the parameters (Block 114). Various parameters could be adjusted to mitigate the vibration. For example, these parameters can include, but are not limited to, weight on bit, rotational speed, torque, pump rate, etc.

D. Stick-Slip Vibration Details

To determine that stick-slip is occurring in Block 108 of FIG. 5, the processor 40 can determine whether any vibration patterns are occurring. Particular techniques are discussed in incorporated U.S. patent application Ser. No. 12/971,202. In general, the processor 40 can derive the toolface velocity using binning and measurements from magnetometers. (Alternatively, the processor 40 can calculate what revolutions the drillstring 4 has made using the angular rate sensor 60 of the present disclosure because this sensor 60 sends out the angular rate over time.) This toolface velocity in turn can be used to determine the toolface of the drilling assembly 10, which may be useful in analyzing the downhole vibrations, such as stick-slip and whirl.

Figure 6:
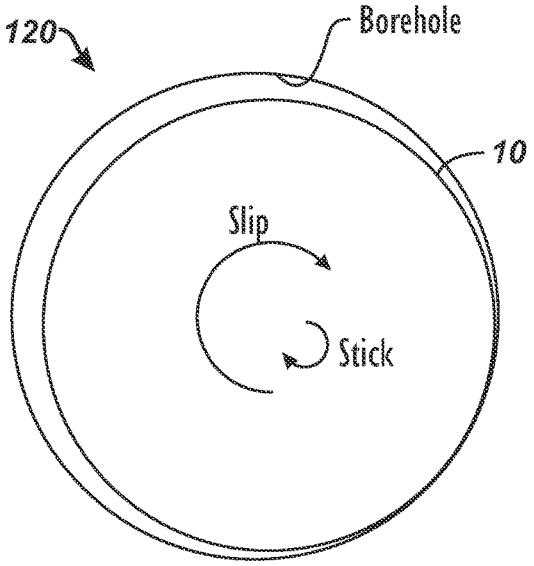
FIG. 6 conceptually shows motion of the drilling assembly in a borehole during stick-slip vibration.

Briefly, stick-slip is a torsional or rotational type of vibration and is caused by the bit 16 interacting with the formation rock or by the drillstring 4 interacting with the borehole wall. FIG. 6 diagrammatically shows an end view of the drilling assembly 10 disposed in a borehole to illustrate stick-slip. As shown, stick-slip 120 usually involves torsional vibration of the drillstring 4 in which the drilling assembly 10 alternates between intervals of stopping and sticking to the borehole and intervals of slippage or increased angular velocity (RPMs) of the drilling assembly 10. During periods of stick-slip 120, the instantaneous bit speeds are much faster than the rotational speed observed at the surface. In fact, the maximum instantaneous RPM at the bit 16 can be several times the average RPM at the surface.

In one way to determine if stick-slip is occurring, processing can use a stick-slip index, which is a dimensionless measurement indicative of stick-slip. Below is an equation for a stick-slip index as found in Macpherson, J., "The Science of Stick-Slip," IADC Stick-Slip Mitigation Workshop, Jul. 15, 2010:

$$SSI = \frac{\max(RPM) - \min(RPM)}{2 \cdot avg(RPM)}.$$

To calculate the index, the maximum rotation (RPM) is subtracted by the minimum rotation (RPM) and the result is divided by twice the average rotation (RPM). The resulting value is indicative of stick-slip. Various values between 0 and 1 can indicate various severity levels of stick-slip, and any value over "1" would indicate a harsh stick-slip condition.

E. Whirl Vibration Details

Figure 7:
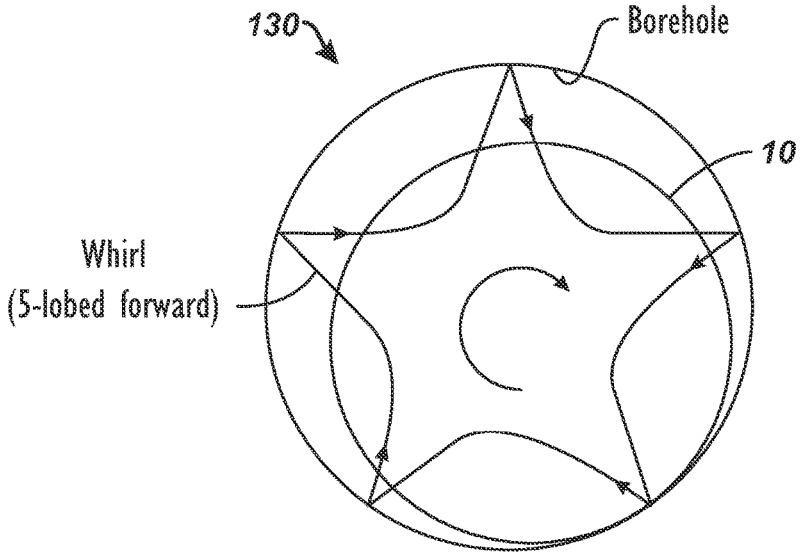
FIG. 7 conceptually shows motion of the drilling assembly in a borehole during whirl vibration.

To determine that whirl is occurring in Block 108 of FIG. 5, the processor 40 can determine any whether vibration patterns are occurring using the derived toolface velocity. Particular techniques are discussed in incorporated U.S. patent application Ser. No. 12/971,202. In contrast to stick-slip, whirl is a bending or lateral type of vibration. FIG. 7 diagrammatically shows an end view of the drilling assembly 10 disposed in a borehole to illustrate bit whirl. In forward whirl, the drilling assembly 10 deflects and precesses around the borehole axis in the same direction that the drilling assembly 10 rotates. In backward whirl, the drilling assembly 10 deflects and precesses around the borehole axis in an opposition direction to drilling assembly's rotation.

As shown in FIG. 7, whirl can have a multiple-lobed, star pattern as the drilling assembly 10 encounters the borehole wall, slowing its RPM, and then rebounds with increased RPM. Whirl usually involves low spots in the RPM that occur when the downhole assembly 10 contacts the borehole wall. Shown here as five lobe whirl, other forms of bit whirl can involve any number of lobes or other characteristic.

During whirl, the average RPM over time would be what is expected from the drilling assembly 10 based on what RPM is imparted at the surface. However, the RPM downhole and the drilling assembly 10 suffer from intervals of high and low RPM that can damage components. As long as rotation is applied, whirl may continue once initiated, and an impediment, such as hard contact or stop, may be needed to interrupt it.

F. Torsional Vibration Details

To determine that torsional vibration (or even torsional resonance) is occurring in Block 108 of FIG. 5, the processor 40 can use measurements from the angular rate sensor 60 in the drilling assembly 10 during drilling. To help illustrate torsional vibration, FIGS. 8A-8B and 9A-9B conceptually show examples 140 of data generated according to the present disclosure by output from an angular rate sensor 60 on the drilling assembly 10.

Each example 140 includes two graphs 150/160. The left graph 150 plots rotational speed 152 over time and graphs a calculated stick-slip index 156 under current conditions. The right graph 160 shows a portion of the data from the angular rate sensor (60) plotted using polar coordinates.

Figure 8B:
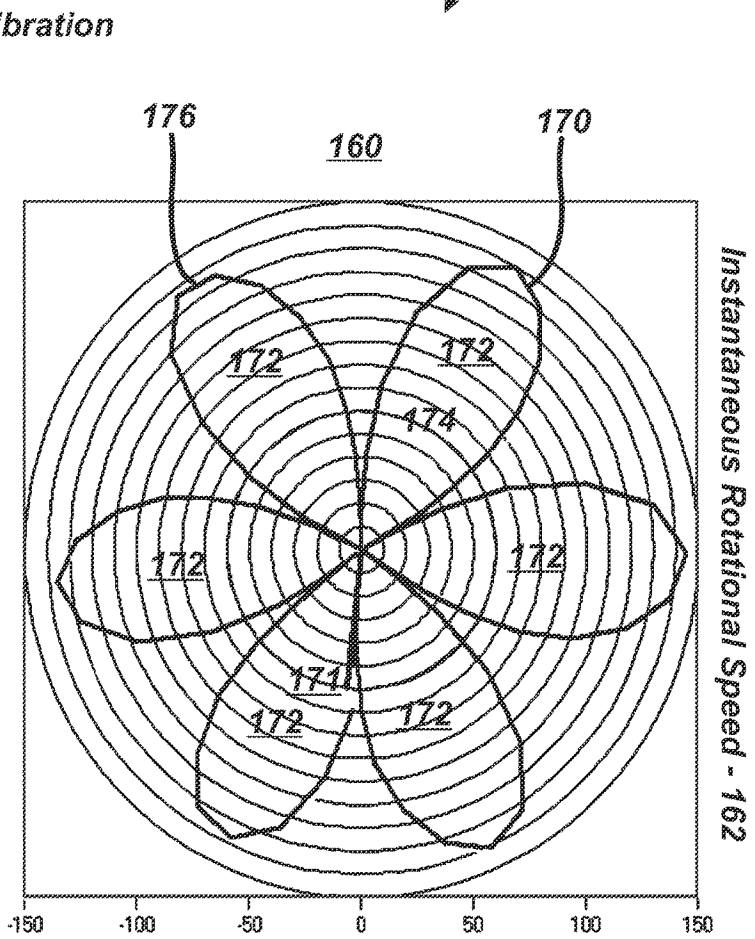
FIGS. 8A-8B show, conceptually in temporal and polar coordinates, output of the angular rate sensor on the drilling assembly during a first type of torsional vibration.
Figure 8A:
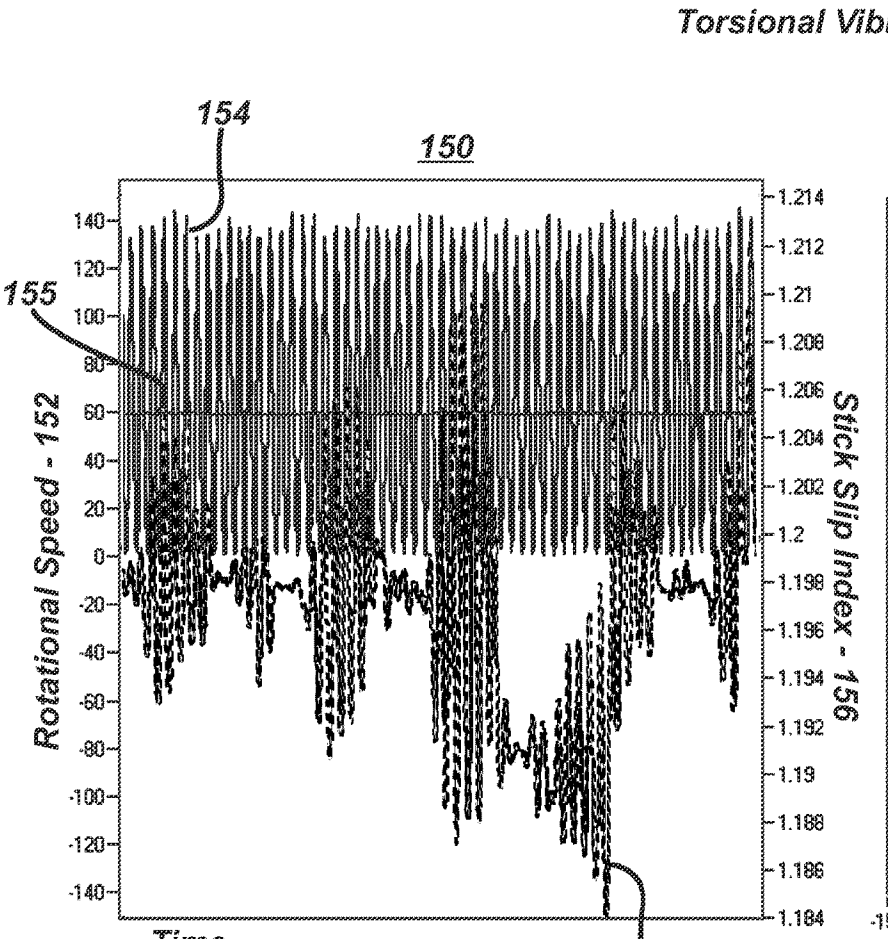

In the graph 150 of FIG. 8A, the line 154 for the rotational speed 152 shows a stick-slip phenomenon occurring with actual rotational speed 152 oscillating between 0 and 140 RPM, while the input rotational speed 155 remains at 60 RPM. The line 158 shows the variation in the stick-slip index calculated for the drilling assembly under the current rotational conditions. As the line 158 shows, the stick-slip index 156 remains elevated above the value one ("1") with punctuated variations.

By contrast, the graph 160 of FIG. 8B shows a portion of the data from the angular rate sensor (60) plotted using polar coordinates. This graph 160 shows the instantaneous rotational speed 162 of the sensor (60) during one or more complete 360-degree revolutions of the tool (20). The plot 170 of instantaneous rotational speed 162 oscillates in a pattern of any number of lobes or cycles 172 as torsional vibration occurs.

The plot 170 begins at 171, and progresses clockwise around the lobes or cycles 172 as the instantaneous rotational speed of the tool (20) changes. Each of the lobes 172 is characterized by a sticking (i.e., slowdown or stoppage) 174 of the drillstring's rotation followed by an increase to (and then decrease from) a slipping 176 of the drillstring's rotation. During the slip 176, the built-up torsion in the drilling assembly (10) releases, causing an increase in rotational speed of the assembly (10).

As can be seen, a form of torsional vibration is occurring. In this example, the torsional vibration has six lobes or cycles 172 in one revolution of the drilling assembly. Thus, the drilling assembly (10) experiences torsional vibration in what can be described as a number of stick-slips in a single revolution.

Figures 9A, 9B:
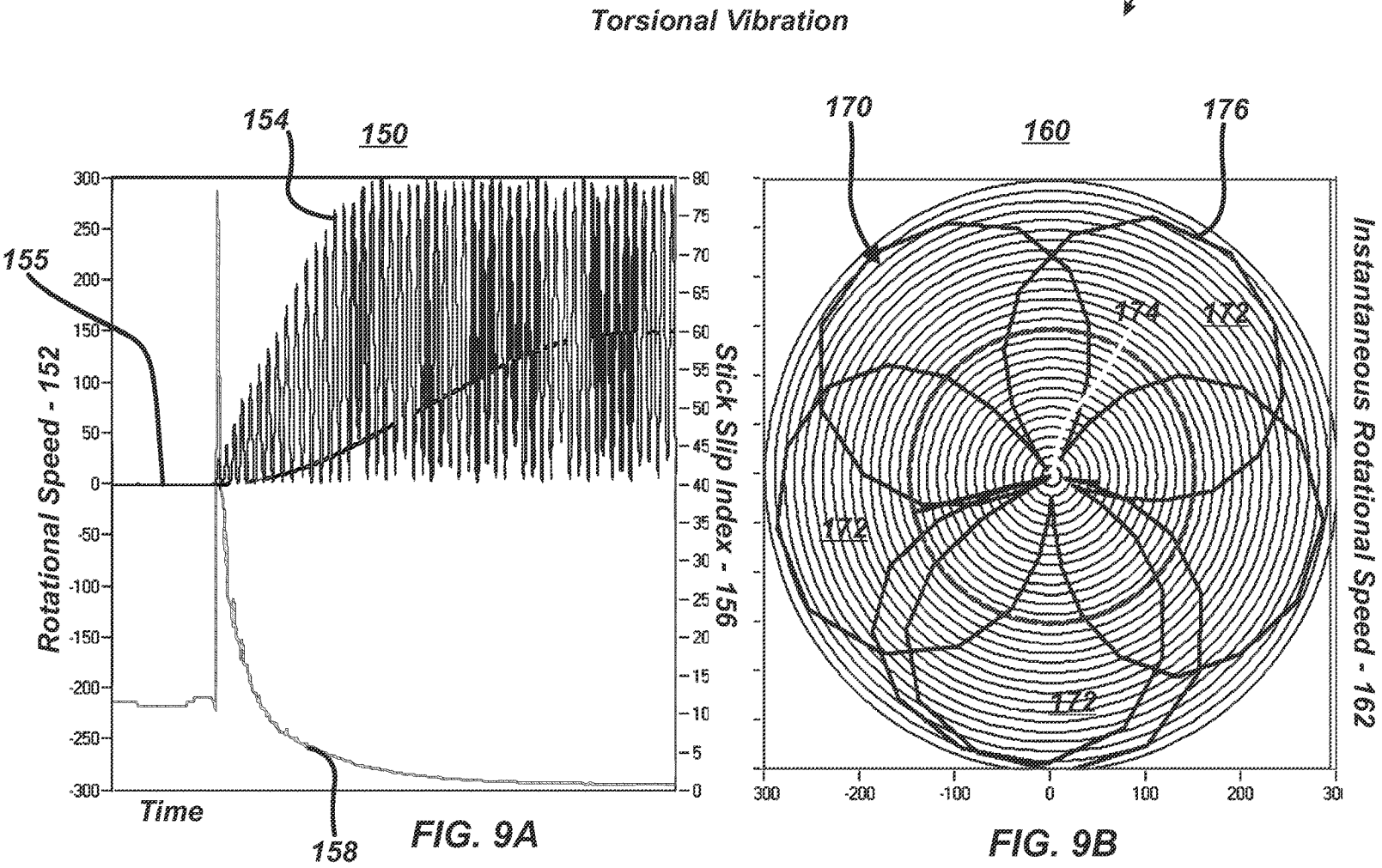
FIGS. 9A-9B show, conceptually in temporal and polar coordinates, output of the angular rate sensor on the drilling assembly during a second type of torsional vibration.
Figures 10A, 10B:
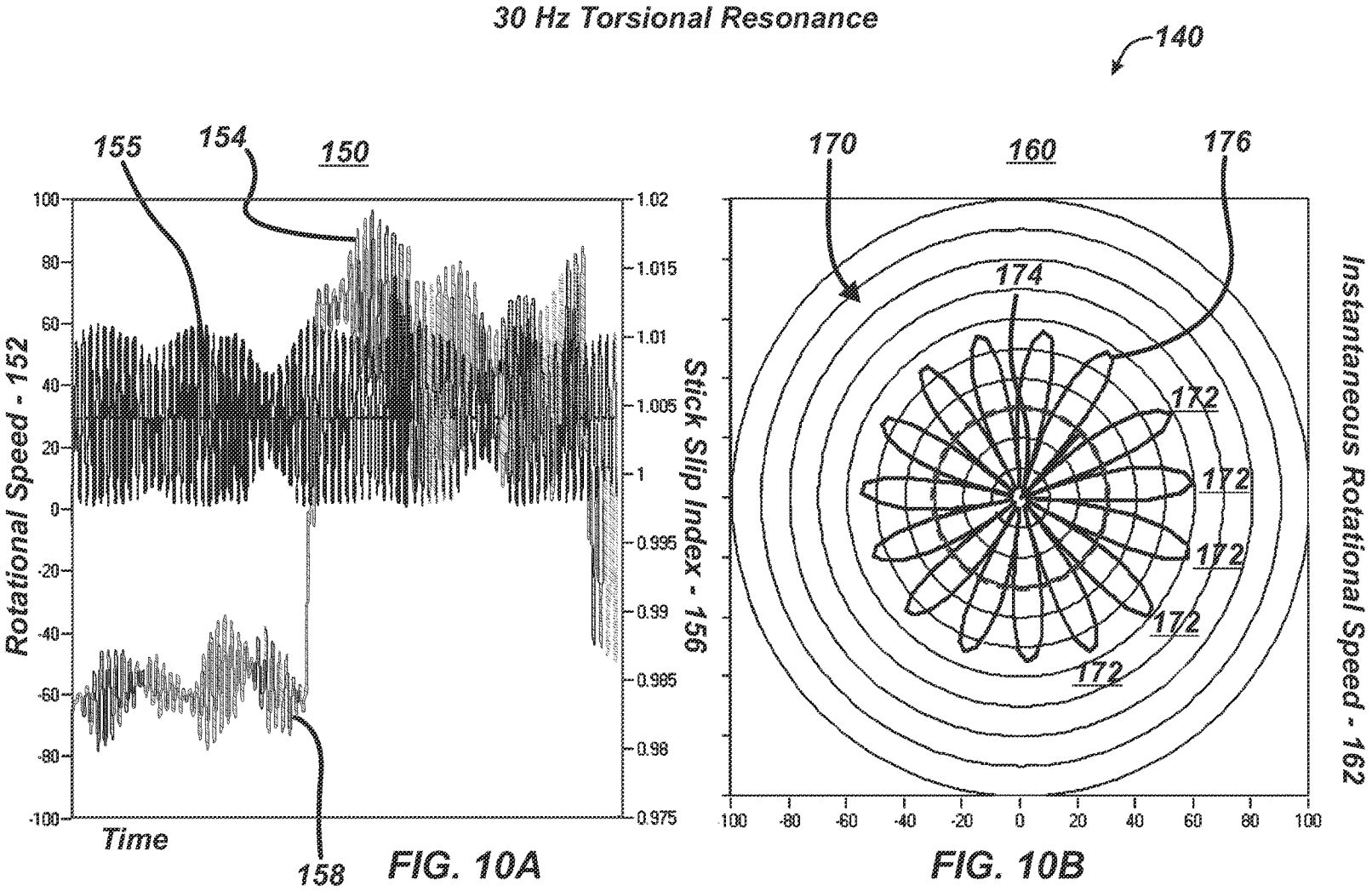
FIGS. 10A-10B show, conceptually in temporal and polar coordinates, output of the angular rate sensor on the drilling assembly during 30 Hz torsional stick-slip.
Figures 11A, 11B:
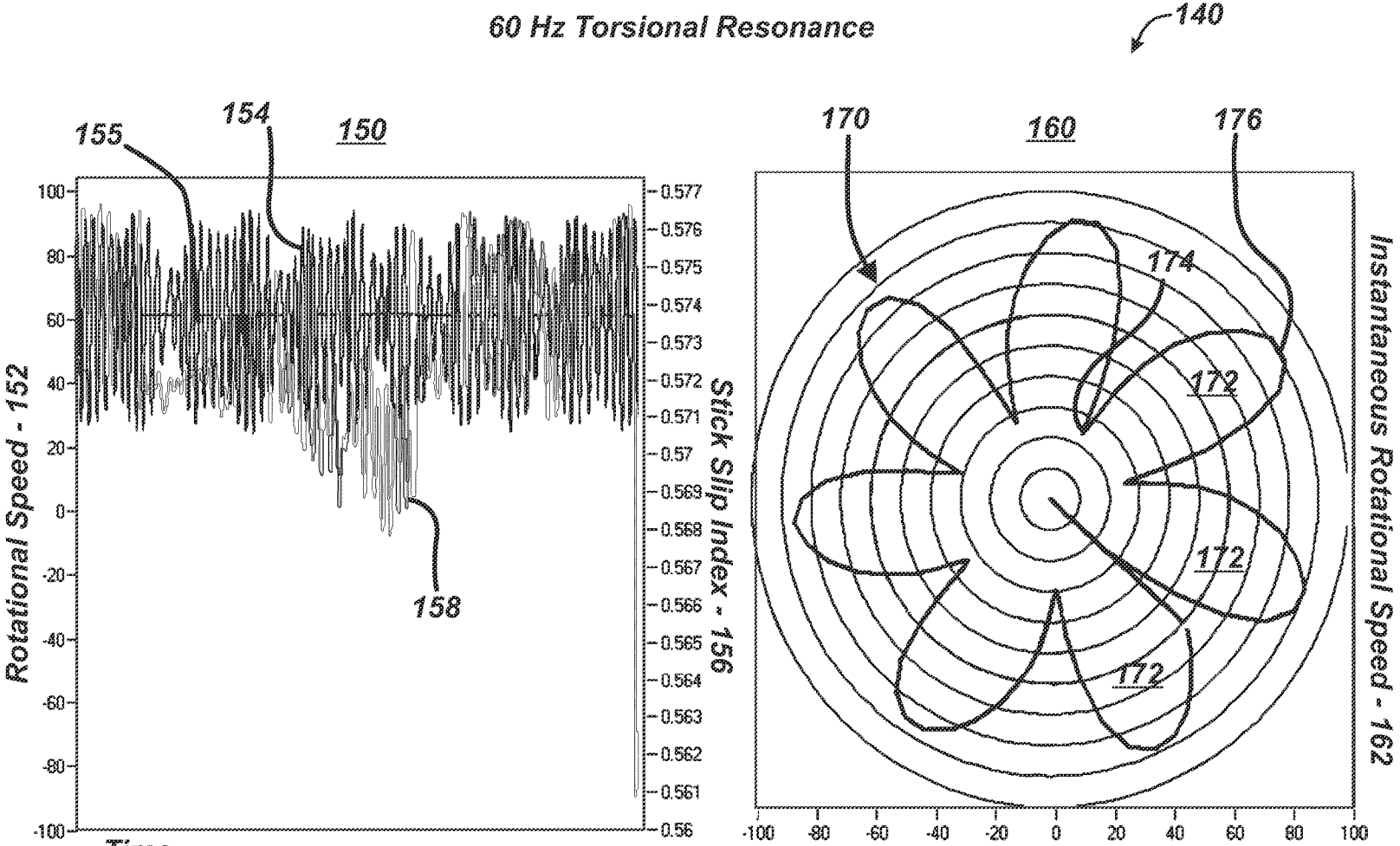
FIGS. 11A-11B show, conceptually in temporal and polar coordinates, output of the angular rate sensor on the drilling assembly during 60 Hz torsional stick-slip.

In the second example of FIGS. 9A-9B, a different behavior at 150 RPM is depicted. In the graph 150 of FIG. 9A, the line 154 for the rotational speed 152 shows a stick-slip phenomenon occurring with actual rotational speed 152 oscillating between 0 and 300 RPM, while the input rotational speed 155 is about 150 RPM. The other line 158 shows the variation in the stick-slip index 156 calculated for the drilling assembly (10) under the current rotational conditions. The scale for the line 158 is to large in the graph to show anything of interest in this example, but the stick-slip index is elevated above 1, which is indicative of severe stick-slip occurring. (It should be noted that the stick-slip index may not be useful during low RPM conditions.)

As before, the graph 160 of FIG. 9B shows a portion of the data from the angular rate sensor (60) plotted using polar coordinates. This graph 160 shows the instantaneous rotational speed 162 of the sensor during more than one complete 360-degree revolution of the tool (20). The plot 170 of instantaneous rotational speed 162 oscillates in a pattern of a number of lobes or cycles 172.

As before, the plot 170 progresses clockwise around the lobes or cycles 172 as the instantaneous rotational speed of the tool (20) changes. Each of the lobes 172 is characterized by a sticking (or stoppage) 174 of the drillstring's rotation followed by an increase to (and then decrease from) a slipping 176 of the drillstring's rotation. During the slipping 176, the built-up torsion in the drilling assembly releases.

As can be seen, a different form of torsional vibration is occurring in FIGS. 9A-9B compared to that of FIGS. 8A-8B. In this example of FIGS. 9A-9B, the torsional vibration has about 2½ lobes 172 in one revolution of the drilling assembly (10). (About five overlapping lobes 172 are actually depicted in plot 170.) Thus, the drilling assembly (10) experiences torsional vibration in what can be described as a number of stick-slips in a single revolution.

Although not shown, it is understood that vibration of the drilling assembly (10) can transition between types of stick-slip 120, whirl 130, and torsional vibration 170 depending on interaction between bending and torsion during operation. Therefore, intermediate or alternative forms of detrimental vibration can develop during drilling and may involve various amounts of bending (lateral) and torsional (rotational) vibration, as well as involving other vibrations, such as axial (longitudinal) vibrations called "bit bounce." The techniques disclosed herein may not only be useful for handling stick-slip, whirl, and torsional vibration, but the disclosed techniques can be used to handle other forms of detrimental vibration as well.

Furthermore, the output of the angular rate sensor 60 as plotted in FIGS. 8A through 9B can also be analyzed according to similar techniques to determine when (and to what extent) stick-slip and whirl are occurring in the drilling assembly (10). Because these forms of vibrations involve sticks and slips over several revolutions, output of the sensor (60) may need to be analyzed over several revolutions of the drilling assembly 10 to detect their occurrence.

FIGS. 10A through 11B conceptually show output of the angular rate sensor (60) on the drilling assembly during 30 Hz torsional resonance and 60 Hz torsional resonance, respectively. The same reference numbers used previously are used in FIGS. 10A through 11B so that description of the elements is not repeated here. As indicated before, the plots 170 of instantaneous rotational speed 162 oscillate in a pattern of a number of lobes or cycles 172, and the stick-slip index 158 is elevated. In addition, these two examples of torsional resonance illustrate how the stick period of the event does not necessarily fall all the way to zero (or full stoppage) as may be presented in other examples of torsional stick-slip. Instead, the stick period reaches a slow down at 174.

G. Forward and Reverse Toolface Oscillation

Figures 12A, 12B:
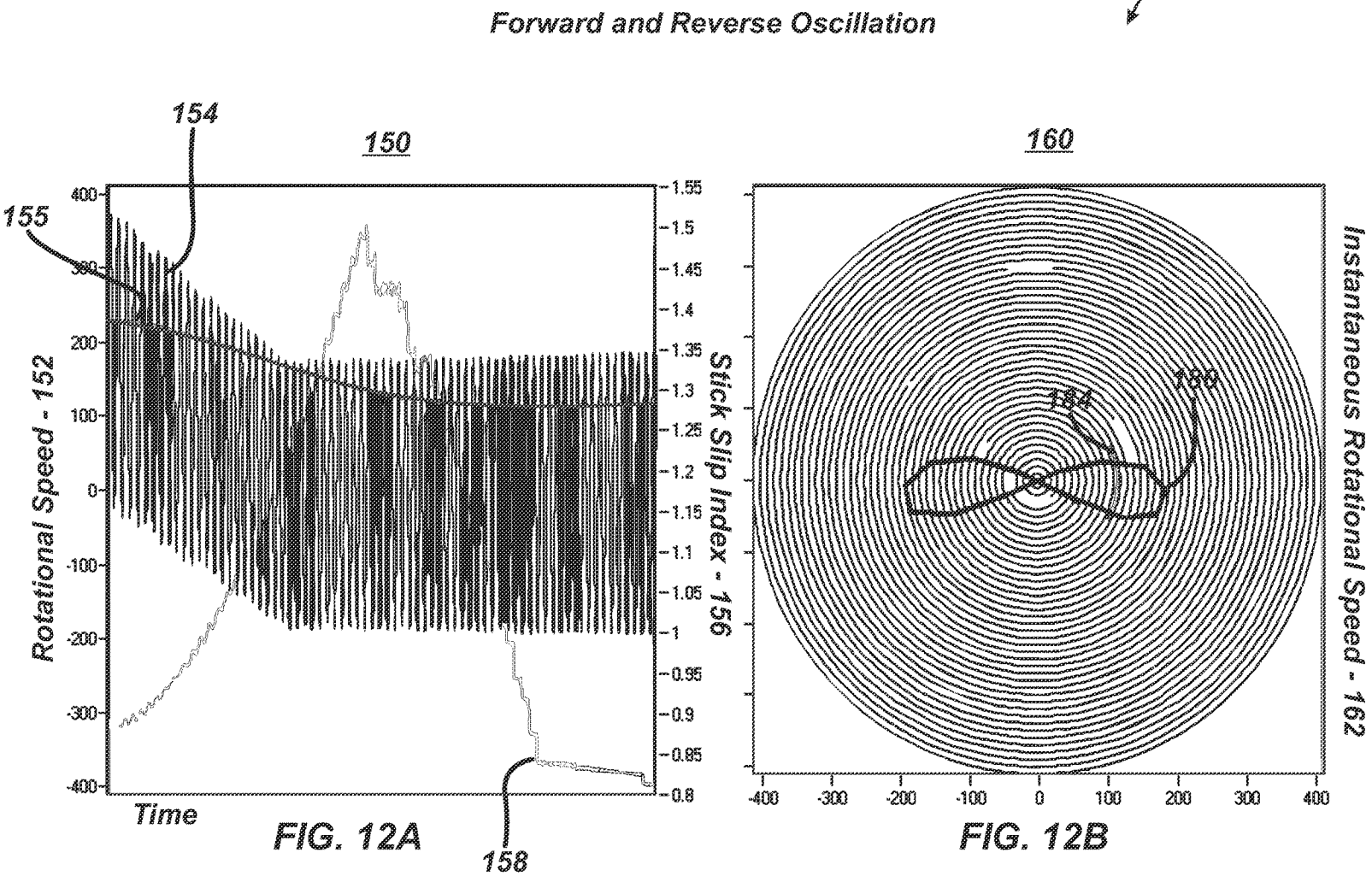
FIGS. 12A-12B show, conceptually in temporal and polar coordinates, output of the angular rate sensor on the drilling assembly during forward and reverse oscillations (as when a drilling motor is used).

In a third example of FIGS. 12A-12B, the data shows the variation in toolface orientation during oriented drilling using a motor—i.e., while sliding. Plot 180 conceptually shows output of the angular rate sensor (60) on the bottom hole assembly during forward and reverse vibration (i.e., back and forth twisting). As this example indicates, output of the angular rate sensor (60) can indicate how much the toolface is varying when oriented directional drilling (sliding) is done with a drilling motor. For example, the line 184 on the polar plot 160 shows how the toolface orientation changes with the forward and reverse vibration. Thus, the angular rate sensor (60) can also be used to measure toolface oscillation during operation and sliding with a drilling motor.

In these measurements, the amplitude of the oscillations may be of interest in controlling the drilling assembly 10. In general, an increased WOB would produce oscillations with greater amplitude. Therefore, the WOB can be manipulated to control the resulting oscillations so drilling can be optimized by decreasing the oscillation's amplitude.

H. Multiple Rotational Stick-Slip

Figures 13A, 13B:
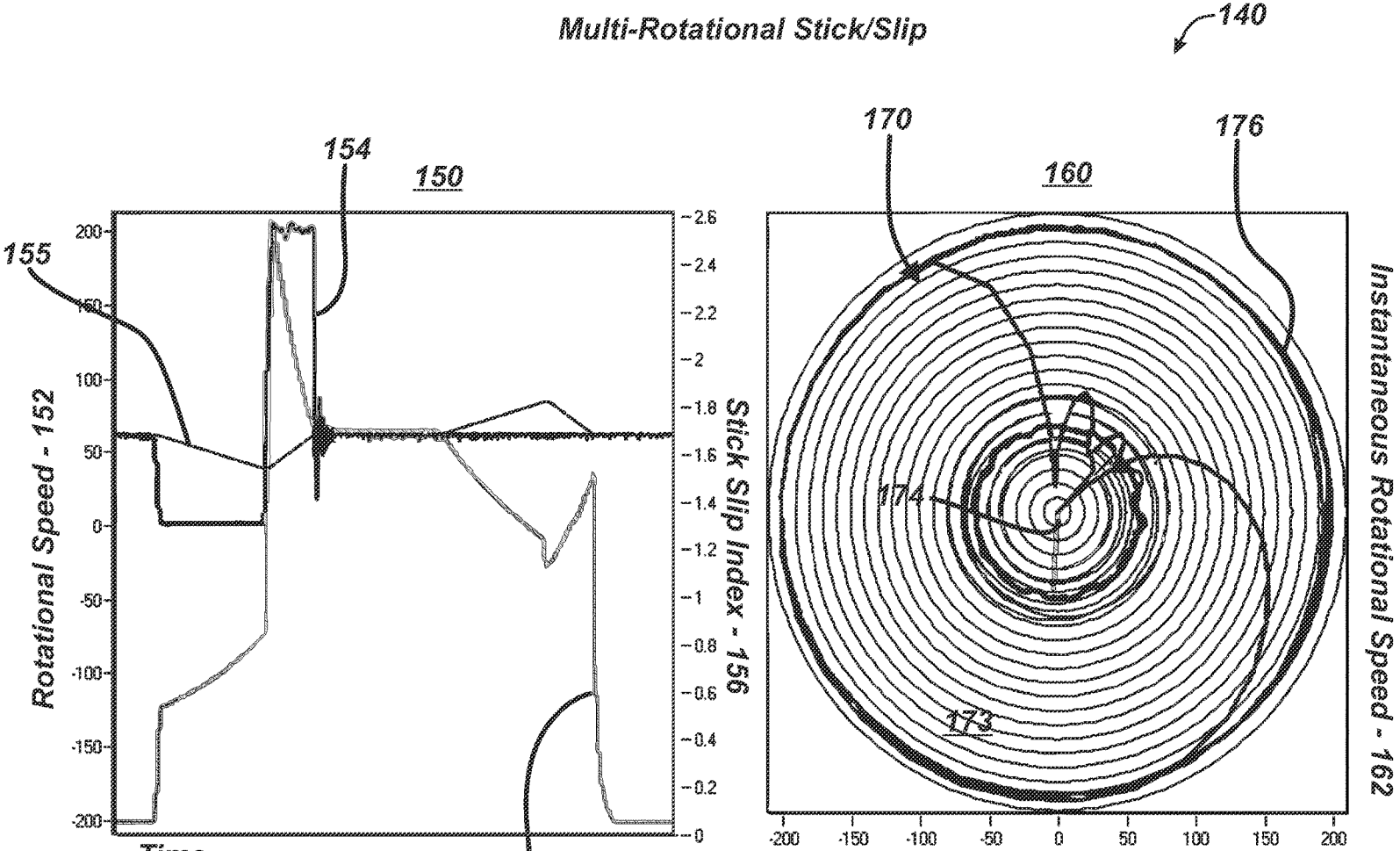
FIGS. 13A-13B show, conceptually in temporal and polar coordinates, output of the angular rate sensor on the drilling assembly during multi-rotational stick-slip.

FIGS. 13A-13B conceptually shows output of the angular rate sensor (60) on the drilling assembly (10) during multi-rotational stick-slip, when the drilling assembly (10) experiences a stick and a slip over a number of revolutions. The stick-slip index 158 elevates to a considerable spike, and the line 154 of the rotational speed 152 decreases to a stop (zero rotational speed 152) and then increases to 200 RPM with the spike of the index 158. Thus, the complete stick of no rotation is for a few seconds and is followed by a 200-RPM slip over multiple rotations. In general, the amount of rotations that the drill string sticks is equivalent to the amount of rotations that the drill string would then slip.

The plot 170 of instantaneous rotational speed 162 comes to a stoppage at 174 and then oscillates in one multi-rotational lobe or cycle 173 with a slippage 176 of increased RPM over several rotations. Overall, this example shows what multi-rotational stick-slip looks like when measured with the angular rate sensor (60) of the present disclosure.

Figure 14A:
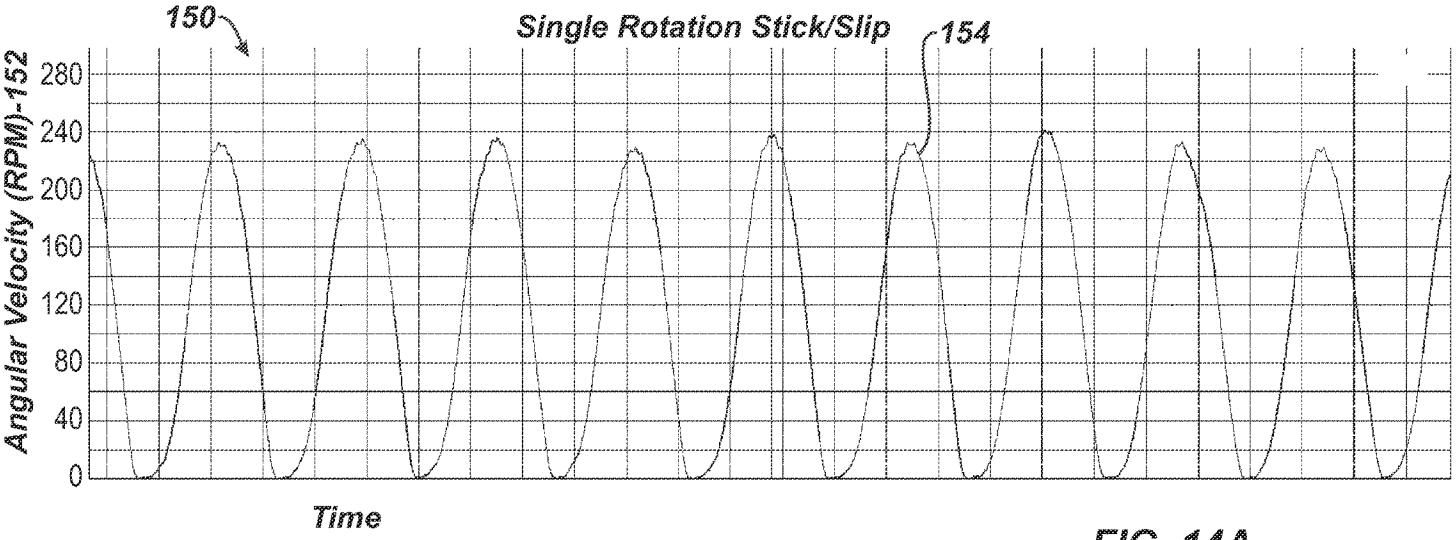
FIGS. 14A-14B show, conceptually in temporal and polar coordinates, output of the angular rate sensor on the drilling assembly during single rotation stick-slip.
Figure 14B:
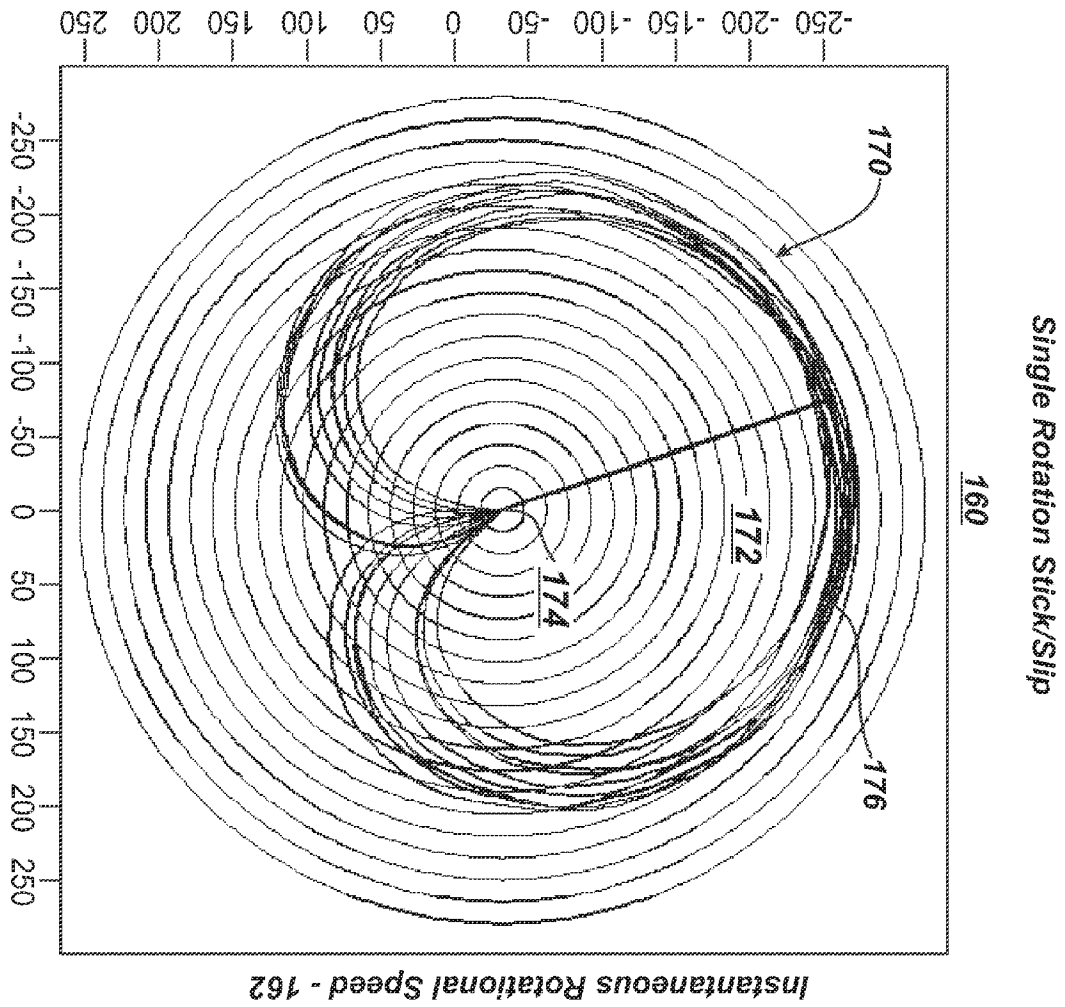

In the next example of FIGS. 14A-14B, a different behavior at about 120 RPM is depicted. In the graph 150 of FIG. 14A, a line 154 for the angular velocity (RPM) 152 shows a stick-slip phenomenon occurring (i.e., one stick and one slip in each rotation). Here, the angular velocity 152 oscillates between 0 and about 240 RPM over one revolution of the drilling assembly. The variation in the stick-slip index calculated for the drilling assembly (10) under the current rotational conditions is not shown in this example, but it would be elevated above 1, which is indicative of stick-slip occurring.

The graph 160 of FIG. 14B shows a portion of the data from the angular rate sensor (60) plotted using polar coordinates. This graph 160 shows the instantaneous rotational speed 162 of the sensor (60) during more than one (e.g., about 9 or so) complete revolutions of the tool (20) at about 120 RPM. Again, the plot 170 of instantaneous rotational speed 162 oscillates in a single lobe or cycle 172 for each revolution.

As before, the plot 170 progresses clockwise around the lobe or cycle 172 as the instantaneous rotational speed 162 of the tool (20) changes. The lobe 172 is characterized by a sticking (or stoppage) 174 of the drillstring's rotation followed by an increase to (and then decrease from) a slipping 176 of the drillstring's rotation. During the slipping 176, the built-up torsion in the drilling assembly releases.

Figure 15:
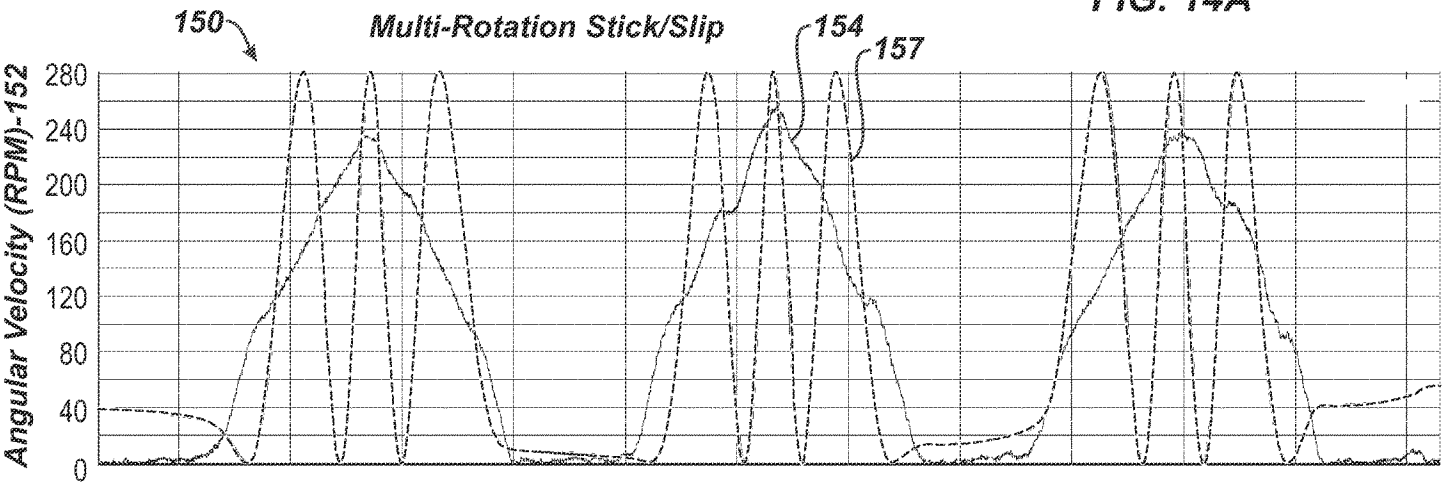
FIG. 15 shows, conceptually in temporal coordinates, output of the angular rate sensor on the drilling assembly during multi-rotation stick-slip.

In a final example of FIG. 15, a graph 150 includes a line 154 for the angular velocity (RPM) 152, showing yet another stick-slip phenomenon occurring (i.e., three rotation sticking followed by a three rotation slipping). Here, the angular velocity 152 oscillates between 0 and about 250 RPM over several (i.e., three) revolutions of the drilling assembly (10). This graph 150 illustrates the angular velocity line 154 over time in comparison to another line 157 that shows the phase of the revolutions of the drilling assembly (10). Although not illustrated here, this information can also be plotted in polar coordinates to conceptually show the multi-rotation stick-slip phenomenon.

I. Torsional Vibration Index

Having an understanding of the angular rate sensor 60, how it is used in the drilling assembly 10, and what information it can provide for analysis, discussion now turns to ways in which measured angular rate of the drilling assembly 10 can be used during drilling to monitor torsional vibration.

Because the drilling assembly 10 is operating downhole, limited bandwidth is available for sending information uphole about current operating conditions. Therefore, determining whether torsional vibration is occurring and to what degree preferably relies on a robust calculation that uses the information available downhole. For example, a severity measure, such as an index or other coefficient, indicative of torsional vibration and its severity can be calculated downhole, and information (e.g., either the index or an alarm condition) can be telemetered uphole for further modifying drilling operations (i.e., to change drilling parameters to avoid or remove vibration).

In general, the severity measure for torsional vibration can determined by finding a pattern of vibration per revolutions of the drilling assembly (10) from the measured angular rate data and then calculating the severity measure of the torsional vibration based on one or more aspects of the determined pattern. The pattern of vibration can involve number of cycles, amplitude, frequency, number of revolutions, etc., as disclosed herein.

For example, an index value for determining torsional vibration can be based on an equation involving variables of (a) the number of lobes or cycles of increased angular rate (i.e., the number of stick-slip cycles per revolution(s)) and (b) the amplitude of the angular rate for those lobes. The torsional vibration index can also involve a frequency of torsional vibration over the RPMs of the drilling assembly 10 and can also figure in the dimensionless measure of a stick-slip index as described previously.

In other words, processing of the angular rate from the sensor 60 can determine when the rate increases and decreases periodically in the revolution of the drilling assembly 10 (i.e., when the plotted output of the sensor 60 produces a lobe). Processing can then count the number of lobes per revolution(s), which would characterize the number of sticks and slips occurring per revolution(s). In addition, the extent of the variations in angular rate (i.e., the amplitude, frequency, and the like of the slips) can be used to point to the severity of the sticks and slips occurring.

In general, processing determines whether torsional vibration is occurring during drilling based on the angular rate values obtained during rotation of the drilling assembly 10. From these angular rate values, processing can calculate a coefficient or index of variation for the angular rate values for the revolutions of the drilling assembly 10. When a pattern is found in the angular rate and/or the calculated index of variations exceed one or more thresholds, processing can determine that detrimental torsional vibration is occurring in the drilling assembly 10.

Moreover, torsional vibration can be visualized as multiples sticks and slips per revolution. Thus, torsional vibration can have similarities to stick-slip because stick-slip can involve multiple sticks and slips during several revolutions of the drillstring 4. Based on this, the known calculation for the stick-slip index of the downhole assembly 10 may be helpful in determining when torsional vibration is occurring during drilling. Accordingly, the torsional vibration calculation can also use the calculation of a standard stick-slip index as part of the determination of torsional vibration index.

Overall, the above-variables combined in an equation can produce a torsional vibration measure or index. Processing can subsequently compare the torsional vibration index to one or more threshold values indicative of the presence, type, and/or severity of torsional vibration occurring. By evaluating these measures with the downhole processor 40, the downhole tool (20) can then encode a value or alarm indicative of torsional vibration for telemetering uphole.

In each of these examples, the processing techniques disclosed herein can indicate detrimental forms of vibration using alarms and warnings. Likewise, the processing techniques can characterize the toolface values, spikes, lobes, intervals, and the like for the detected vibrations so that drilling operators can have a better understanding on the types of vibrations encountered downhole. From this information, operators can alter parameters to reduce or eliminate the problems and improve the drilling efficiency.

J. Additional Drilling Assemblies

Figure 16A:
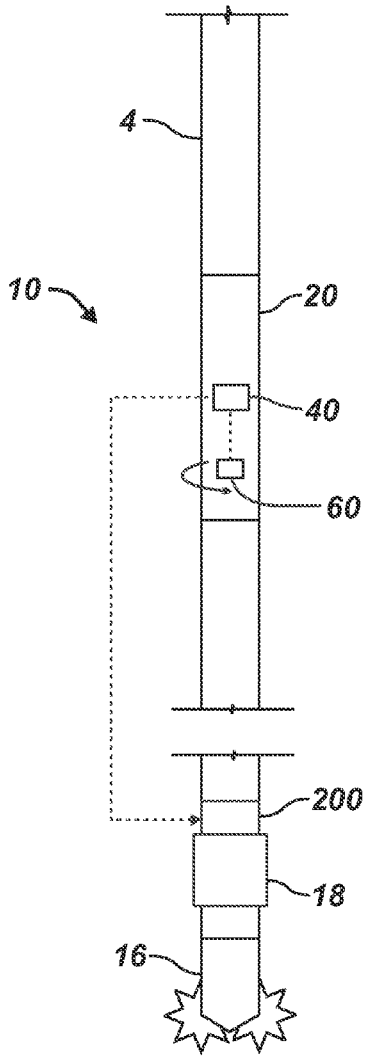
FIG. 16A illustrates a drilling assembly having a monitoring tool and a drilling interrupting mechanism.

FIG. 16A illustrates a drilling assembly 10 having a monitoring tool 20 and a drilling interrupting mechanism 200. The processor 40 of the tool 20 obtains angular rate measurements from an angular rate sensor 60 and determines parameters indicative of detrimental vibration, such as whirl, stick-slip, or torsional vibration, as disclosed herein. With respect to vibration, the processor 40 then communicates a feedback signal to the drilling interrupting mechanism 200 to automatically interrupt the drilling performed by the drill bit 16. How the feedback signal is communicated depends on the type of mechanism 200 used and the other components of the drilling assembly 10. In general, the feedback signal can be communicated with an electrical signal, hydraulics, pressure pulse, or other known technique.

As shown in FIG. 16A, the mechanism 200 can be disposed downhole of the tool 20. Several types of mechanisms could be used. For example, the mechanism 200 can be a clutch, brake, or the like that can change the torque applied to the drill bit 16. Alternatively, the mechanism 200 can be an actuatable valve that alters the flow of drilling mud to affect the drilling operations, or the mechanism 200 can be an actuatable vibrator that vibrates the drill collar 20 of the assembly 10 to alter the drilling operations. One skilled in the art with the benefit of the present disclosure will appreciate that these and other types of mechanisms can be used to automatically alter the drilling operation based on a feedback signal from the tool 20.

In one example, the mechanism 200 can use a clutch or brake similar to features disclosed in U.S. Pat. Pub. No. 2011/0108327 and U.S. Pat. Nos. 3,841,420; 3,713,500; and 5,738,178, which are incorporated herein by reference. In general, the clutch/brake mechanism 200 can be disposed in the mud motor 18 of the assembly 10, but can be disposed at other positions within the motor-drill bit drive train.

The clutch/brake mechanism 200 can use a plain brake, a hydraulic multidisc clutch, or a hysteresis clutch located within the motor-bit drive train or within the drill string 4 above the motor 18. The processor 40 of the tool 20 cooperates with the clutch/brake mechanism 200 to activate during rotation of the assembly 10 when detrimental vibrations occur. This results in a variation in rotational speed of the drill bit 16, thereby altering drilling parameters to counteract or deter the detrimental vibration.

In another example, the mechanism 200 can include a drilling fluid variable bypass orifice that controls the flow of drilling fluid through the mud motor 18 similar to that disclosed in incorporated U.S. Pat. Pub. No. 2011/0108327. The mechanism 200 can be disposed above the mud motor 18, within the mud motor 18, or elsewhere on the assembly 10. Variation in fluid flow through the bypass orifice of the variable orifice mechanism 200 results in a corresponding variation in the rotational speed of the drill bit 18. Accordingly, the processor 40 of the tool 20 cooperates with the variable orifice mechanism 20 when detrimental vibrations occur to activate during rotation of the assembly 10 and alter drilling parameters.

Figure 16B:
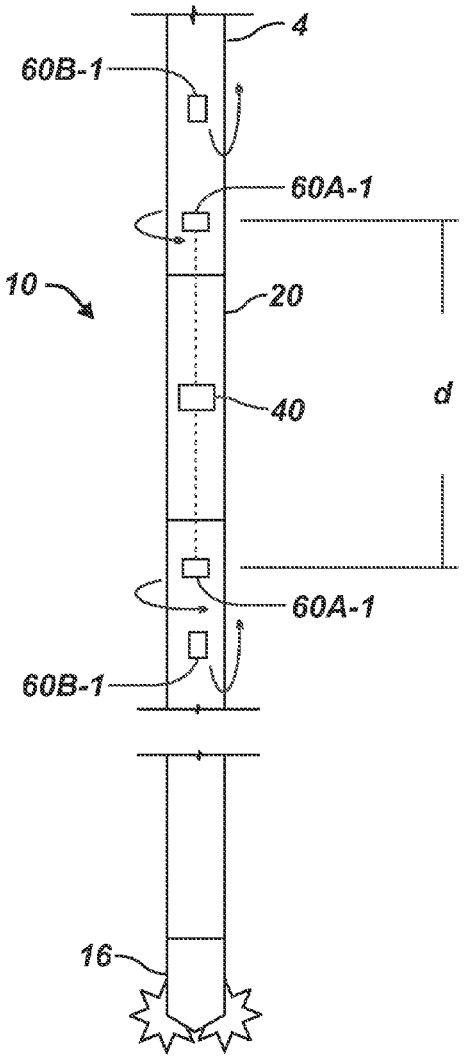
FIG. 16B illustrates a drilling assembly having a monitoring tool and uphole and downhole angular rate sensors.

FIG. 16B illustrates a drilling assembly 10 having a monitoring tool 20 and uphole and downhole angular rate sensors 60A-1 and 60A-2 displaced by a distance d on the assembly 10. The processor 40 of the tool 20 obtains angular rate measurements from the displaced angular rate sensors 60A-1 and 60A-2. Comparing the angular rate measurements, the processor 40 can determine characteristics of the torsional vibration, bending, or twisting of the assembly 10 during drilling. In the end, the compared measurements can give a more comprehensive view of the torsional vibration of the assembly 10.

The displacement d of the sensors 60A-1 and 60A-2 can be configured for a particular implementation so that the torsional vibration can be determined over more or less of the length of the assembly 10 and the drillstring 4. Additionally, more than two such sensors 60A-60B can be used for more comprehensive characterization.

To make further characterizations of the assembly's vibration, other uphole and downhole angular rate sensors 60B-1 and 60B-2 can be displaced on the assembly 10. These sensors 60B-1 and 60B-2 can be oriented to measure rotation of the assembly 10 along its longitudinal axis (i.e., to measure bending of the assembly 10). The processor 40 of the tool 20 obtains angular rate measurements from these displaced sensors 60B-1 and 60B-2 and compares the measurements to determine characteristics of the vibration or bending of the assembly 10 during drilling.

As will be appreciated with the benefit of the present disclosure, these and other arrangements of multiple angular rate sensors 60 can be used to measure the angular rate at various locations and in various planes along the drilling assembly 10 so that comparisons of the measurements can characterize the vibration of the assembly 10.

K. Concluding Remarks

As will be appreciated, teachings of the present disclosure can be implemented in digital electronic circuitry, computer hardware, computer firmware, computer software, or any combination thereof. Teachings of the present disclosure can be implemented in a computer program product tangibly embodied in a machine-readable storage device for execution by a programmable processor so that the programmable processor executing program instructions can perform functions of the present disclosure. The teachings of the present disclosure can be implemented advantageously in one or more computer programs that are executable on a programmable system including at least one programmable processor coupled to receive data and instructions from, and to transmit data and instructions to, a data storage system, at least one input device, and at least one output device. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole drilling vibration analysis method, comprising:

drilling a borehole with a drilling assembly having at least one angular rate sensor;

determining angular positions of the drilling assembly about a circumference of the borehole while drilling downhole;

measuring instantaneous angular rates of the drilling assembly with the at least one angular rate sensor while drilling downhole;

analyzing changes of the measured instantaneous angular rates occurring at least at a plurality of the determined angular positions of the drilling assembly about the circumference of the borehole by determining, at which of the angular positions of the drilling assembly about the circumference of the borehole, decrease in the instantaneous angular rates occurs, the decrease being indicative of a sticking of the drilling assembly at the determined angular position; and determining that torsional vibration is occurring during drilling based on the analysis.

2. The method of claim 1, wherein measuring the instantaneous angular rates of the drilling assembly with the at least one angular rate sensor while drilling downhole comprises measuring the instantaneous angular rates with an angular rate gyroscope responsive to Coriolis acceleration.

3. The method of claim 1, wherein analyzing the changes of the measured instantaneous angular rates occurring at least at the plurality of the determined angular positions of the drilling assembly about the circumference of the borehole comprises determining, from the changes, a pattern of vibration per one or more revolutions of the drilling assembly.

4. The method of claim 3, wherein determining that torsional vibration is occurring during drilling based on the analysis comprises determining a severity measure of the torsional vibration based on one or more aspects of the determined pattern.

5. The method of claim 1, wherein analyzing the changes of the measured instantaneous angular occurring at least at the plurality of the determined angular positions of the drilling assembly about the circumference of the borehole comprises determining, from the changes, one or more cycles of increased angular rate of the measured instantaneous angular rates per one or more revolutions of the drilling assembly.

6. The method of claim 5, wherein determining that torsional vibration is occurring during drilling based on the analysis comprises calculating a torsional vibration measure, indicative of the torsional vibration, based on a number of the one or more cycles.

7. The method of claim 5, wherein determining that torsional vibration is occurring during drilling based on the analysis comprises calculating a torsional vibration measure, indicative of the torsional vibration, based on an amplitude of the one or more cycles.

8. The method of claim 1, wherein analyzing the changes of the measured instantaneous angular rates occurring at least at the plurality of the determined angular positions of the drilling assembly about the circumference of the borehole comprises determining, from the changes, vibration over revolutions over time of the drilling assembly.

9. The method of claim 8, wherein determining that torsional vibration is occurring during drilling based on the analysis comprises calculating a torsional vibration measure, indicative of the torsional vibration, based on a frequency of the vibration over the revolutions over time of the drilling assembly.

10. The method of claim 1, wherein determining that torsional vibration is occurring during drilling based on the analysis further comprises augmenting the determination by calculating a dimensionless measure relating a maximum revolutions over time, a minimum revolutions over time, and an average revolutions over time.

11. The method of claim 1, wherein the at least one angular rate sensor comprises at least two angular rate sensors displaced along the drilling assembly.

12. The method of claim 11, wherein measuring the instantaneous angular rates comprises measuring the instantaneous angular rates about a same axis with the at least two angular rate sensors downhole while drilling with the drilling assembly.

13. The method of claim 11, wherein analyzing the measured instantaneous angular rates comprises comparing the instantaneous angular rates from the at least two angular rate sensors.

14. The method of claim 13, wherein determining that torsional vibration is occurring during drilling based on the analysis comprises determining an aspect of at least one of bending and twisting of the drilling assembly based on the comparison.

15. The method of claim 1, further comprising changing one or more operating parameters of the drilling assembly based on the determined torsional vibration.

16. The method of claim 15, wherein changing the one or more operating parameters of the drilling assembly comprises changing one or more of weight on bit, rotational speed, torque, pump rate, mud flow rate, and mud motor operation.

17. The method of claim 15, wherein changing the one or more operating parameters comprises operating a drilling interrupting mechanism on the drilling assembly based on the determined torsional vibration.

18. The method of claim 1, wherein analyzing the changes and determining the torsional vibration comprises at least partially processing the measured angular rate data downhole at the drilling assembly.

19. The method of claim 18, wherein analyzing the changes and determining the torsional vibration comprises communicating the at least partially processed angular rate data from the drilling assembly to the surface.

20. The method of claim 19, wherein analyzing the changes and determining the torsional vibration comprises completing processing of the measured angular rate data downhole at the surface.

21. The method of claim 1, wherein determining the angular positions of the drilling assembly about the circumference of the borehole while drilling downhole comprises measuring orientations of magnetometers with respect to the earth's magnetic field and calculating the angular positions from the measured orientations.

22. The method of claim 1, wherein determining the angular positions of the drilling assembly about the circumference of the borehole while drilling downhole comprises measuring orientations of accelerometers with respect to the earth's gravitational field and calculating the angular positions from the measured orientations.

23. The method of claim 1, wherein measuring the instantaneous angular rates of the drilling assembly with the at least one angular rate sensor while drilling downhole comprises measuring magnitudes related to tangential speed, per angular position, per time.

24. The method of claim 1, wherein determining the angular positions of the drilling assembly about the circumference of the borehole while drilling downhole comprises at least periodically determining a geometric reference of the angular positions of the drilling assembly within the borehole during drilling.

25. The method of claim 1, further comprising at least periodically determining bias of the at least one angular rate sensor when rotation of the drilling assembly is stopped, wherein measuring the instantaneous angular rates comprises correcting the measurements for the determined bias.

26. The method of claim 1, wherein analyzing the changes of the measured instantaneous angular rates occurring at least at the plurality of the determined angular positions of the drilling assembly about the circumference of the borehole further comprises determining, at which of the angular positions of the drilling assembly about the circumference of the borehole, increase in the instantaneous angular rates occurs, the increase being indicative of a slipping of the drilling assembly at the determined angular position.

27. The method of claim 1, wherein determining that the torsional vibration is occurring during drilling based on the analysis comprises determining the torsional vibration selected from the group consisting of stick-slip, bit whirl, precessional movement, forward whirl, backward whirl, torsional variation, elastic deformation, bending, twisting, and combinations thereof.

28. A downhole drilling vibration analysis method, comprising:

drilling a borehole with a drilling assembly having an angular rate sensor;

determining rotational positions of the drilling assembly about a circumference of the borehole while drilling downhole;

measuring instantaneous rotational speeds of the drilling assembly with the angular rate sensor while drilling downhole;

analyzing changes of the measured instantaneous rotational speeds occurring at least at a plurality of the determined rotational positions of the drilling assembly about the circumference of the borehole by determining, at which of the determined rotational positions, decrease and/or increase in the instantaneous rotational speeds occurs, the decrease being indicative of a sticking of the drilling assembly at the determined rotational position, the increase being indicative of a slipping of the drilling assembly at the determined rotational position; and determining that torsional vibration is occurring during drilling based on the analysis.

29. A drilling assembly for drilling a borehole, the assembly comprising:

a drill collar disposed on a drill string;

a drill bit disposed on the drill collar;

a sensor element disposed on the drill collar and determining angular positions of the drilling assembly about a circumference of the borehole while drilling downhole, the sensor element including at least one angular rate sensor measuring instantaneous angular rates downhole while drilling with the drilling assembly; and processing circuitry in communication with the sensor element, the processing circuitry is configured to:

analyze changes of the measured instantaneous angular rates occurring at least at a plurality of the determined angular positions of the drilling assembly about the circumference of the borehole to determine, at which of the angular positions of the drilling assembly about the circumference of the borehole, decrease in the instantaneous angular rates occurs, the decrease being indicative of a sticking of the drilling assembly at the determined angular position, and determine that torsional vibration is occurring during drilling based on the analysis.

30. The assembly of claim 29, wherein the at least one angular rate sensor comprises an angular rate gyroscope responsive to Coriolis acceleration.

31. The assembly of claim 29, wherein the processing circuitry comprises first circuitry disposed on the drill collar.

32. The assembly of claim 29, wherein the processing circuitry comprises second circuitry disposed at the surface.

33. The assembly of claim 29, further comprising telemetry unit communicating information indicative of the torsional vibration from the drill collar to the surface.

34. The assembly of claim 29, further comprising a mechanism disposed on the drilling assembly and operable to interrupt drilling by the drill bit.

35. The system of claim 29, wherein to analyze the changes of the measured instantaneous angular rates occurring at least at a plurality of the determined angular positions of the drilling assembly about the circumference of the borehole, the processing circuitry is configured to: determine, at which of the angular positions of the drilling assembly about the circumference of the borehole, increase in the instantaneous angular rates occurs, the increase being indicative of a slipping of the drilling assembly at the determined angular position.

36. A downhole drilling vibration analysis method, comprising:

drilling a borehole with a drilling assembly having at least one angular rate sensor;

determining angular positions of the drilling assembly about a circumference of the borehole while drilling downhole;

measuring instantaneous angular rates of the drilling assembly with the at least one angular rate sensor while drilling downhole;

analyzing changes of the measured instantaneous angular rates occurring at least at a plurality of the determined angular positions of the drilling assembly about the circumference of the borehole by determining, at which of the angular positions of the drilling assembly about the circumference of the borehole, increase in the instantaneous angular rates occurs, the increase being indicative of a slipping of the drilling assembly at the determined angular position; and determining that torsional vibration is occurring during drilling based on the analysis.

37. The method of claim 36, wherein measuring the instantaneous angular rates of the drilling assembly with the at least one angular rate sensor while drilling downhole comprises measuring the instantaneous angular rates with an angular rate gyroscope responsive to Coriolis acceleration.

38. The method of claim 36, wherein measuring the instantaneous angular rates of the drilling assembly with the at least one angular rate sensor while drilling downhole comprises measuring magnitudes related to tangential speed, per angular position, per time.

39. The method of claim 36, wherein analyzing the changes of the measured instantaneous angular rates occurring at least at the plurality of the determined angular positions of the drilling assembly about the circumference of the borehole comprises determining, from the changes, a pattern of vibration per one or more revolutions of the drilling assembly; and wherein determining that torsional vibration is occurring during drilling based on the analysis comprises determining a severity measure of the torsional vibration based on one or more aspects of the determined pattern.

40. The method of claim 36, wherein analyzing the changes of the measured instantaneous angular occurring at least at the plurality of the determined angular positions of the drilling assembly about the circumference of the borehole comprises determining, from the changes, one or more cycles of increased angular rate of the measured instantaneous angular rates per one or more revolutions of the drilling assembly; and wherein determining that torsional vibration is occurring during drilling based on the analysis comprises calculating a torsional vibration measure, indicative of the torsional vibration, based on a number of the one or more cycles and/or based on an amplitude of the one or more cycles.

41. The method of claim 36, wherein analyzing the changes of the measured instantaneous angular rates occurring at least at the plurality of the determined angular positions of the drilling assembly about the circumference of the borehole comprises determining, from the changes, vibration over revolutions over time of the drilling assembly; and wherein determining that torsional vibration is occurring during drilling based on the analysis comprises calculating a torsional vibration measure, indicative of the torsional vibration, based on a frequency of the vibration over the revolutions over time of the drilling assembly.

42. The method of claim 36, wherein the at least one angular rate sensor comprises at least two angular rate sensors displaced along the drilling assembly; wherein measuring the instantaneous angular rates comprises measuring the instantaneous angular rates about a same axis with the at least two angular rate sensors downhole while drilling with the drilling assembly; wherein analyzing the measured instantaneous angular rates comprises comparing the instantaneous angular rates from the at least two angular rate sensors; and wherein determining that torsional vibration is occurring during drilling based on the analysis comprises determining an aspect of at least one of bending and twisting of the drilling assembly based on the comparison.

43. The method of claim 36, further comprising changing one or more operating parameters of the drilling assembly based on the determined torsional vibration.

44. The method of claim 43, wherein changing the one or more operating parameters of the drilling assembly comprises: changing one or more of weight on bit, rotational speed, torque, pump rate, mud flow rate, and mud motor operation; and/or operating a drilling interrupting mechanism on the drilling assembly based on the determined torsional vibration.

45. The method of claim 36, wherein determining the angular positions of the drilling assembly about the circumference of the borehole while drilling downhole comprises: measuring orientations of magnetometers with respect to the earth's magnetic field and calculating the angular positions from the measured orientations; or measuring orientations of accelerometers with respect to the earth's gravitational field and calculating the angular positions from the measured orientations; or at least periodically determining a geometric reference of the angular positions of the drilling assembly within the borehole during drilling.

46. The method of claim 36, further comprising at least periodically determining bias of the at least one angular rate sensor when rotation of the drilling assembly is stopped, wherein measuring the instantaneous angular rates comprises correcting the measurements for the determined bias.

47. A drilling assembly for drilling a borehole, the assembly comprising:

a drill collar disposed on a drill string;

a drill bit disposed on the drill collar;

a sensor element disposed on the drill collar and determining angular positions of the drilling assembly about a circumference of the borehole while drilling downhole, the sensor element including at least one angular rate sensor measuring instantaneous angular rates downhole while drilling with the drilling assembly; and processing circuitry in communication with the sensor element, the processing circuitry is configured to:

analyze changes of the measured instantaneous angular rates occurring at least at a plurality of the determined angular positions of the drilling assembly about the circumference of the borehole to determine, at which of the angular positions of the drilling assembly about the circumference of the borehole, increase in the instantaneous angular rates occurs, the increase being indicative of a slipping of the drilling assembly at the determined angular position, and determine that torsional vibration is occurring during drilling based on the analysis.

48. The assembly of claim 47, wherein the at least one angular rate sensor comprises an angular rate gyroscope responsive to Coriolis acceleration.

49. The assembly of claim 47, further comprising a mechanism disposed on the drilling assembly and operable to interrupt drilling by the drill bit.

* * * * *